US010875319B2

(12) United States Patent
Ozawa

(10) Patent No.: US 10,875,319 B2
(45) Date of Patent: Dec. 29, 2020

(54) METHOD OF CLEANING LIQUID DISCHARGING APPARATUS

(71) Applicant: SEIKO EPSON CORPORATION, Tokyo (JP)

(72) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/798,836

(22) Filed: Feb. 24, 2020

(65) Prior Publication Data

US 2020/0269595 A1 Aug. 27, 2020

(30) Foreign Application Priority Data

Feb. 26, 2019 (JP) ..... 2019-032855

(51) Int. Cl.
*B41J 2/175* (2006.01)
*B41J 2/17* (2006.01)
*B41J 2/165* (2006.01)

(52) U.S. Cl.
CPC ..... *B41J 2/17596* (2013.01); *B41J 2/16552* (2013.01); *B41J 2/175* (2013.01); *B41J 2/1707* (2013.01)

(58) Field of Classification Search
CPC ... B41J 2/16552; B41J 2/17596; B41J 2/1707
See application file for complete search history.

(56) References Cited

U.S. PATENT DOCUMENTS 5,786,829 A * 7/1998 Pasciak, Jr. et al. .. B41J 2/1707
2002/0175969 A1* 11/2002 Suzuki ..... B41J 2/16552
2005/0116970 A1* 6/2005 Nakazawa ..... B41J 2/1707

FOREIGN PATENT DOCUMENTS

JP 2011-235470 11/2011

* cited by examiner

*Primary Examiner* — Juanita D Jackson
(74) *Attorney, Agent, or Firm* — Workman Nydegger

(57) ABSTRACT

A method of cleaning a liquid discharging apparatus has a second flow path cleaning step of causing a cleaning liquid to pass through a second flow path so that the second flow path is cleaned, and also includes a first flow path cleaning step of causing the cleaning liquid that has passed through the second flow path to pass through a first flow path so that the first flow path is cleaned.

4 Claims, 26 Drawing Sheets

METHOD OF CLEANING LIQUID DISCHARGING APPARATUS

The present application is based on, and claims priority from JP Application Serial Number 2019-032855, filed Feb. 26, 2019, the disclosure of which is hereby incorporated by reference herein in its entirety.

BACKGROUND

1. Technical Field

The present disclosure relates to a technology for cleaning a liquid discharging apparatus.

2. Related Art

When a plurality of types of inks such as inks in different colors or inks having different components are selectively used in a single discharging head in a printer or another image forming apparatus in relate art, inks in an ink supply element need to be replaced. In a technology in related art, a cleaning liquid and air are alternately fed under pressure from the upstream of a supply flow path from which an ink is supplied to the discharging head to clean the ink supply element (see JP-A-2011-235470).

When, in the technology in related art, a cleaning liquid is supplied from the upstream of the supply flow path toward the discharging head, the interior of the supply flow path, which is positioned upstream of the discharging head, is cleaned by the cleaning liquid. Therefore, the cleaning liquid that has passed through the supply flow path and reached the discharging head may have been highly contaminated. In general, the flow path in the discharging head is narrow and has a smaller volume than the supply flow path. Accordingly, when the discharging head having a small volume is cleaned with a cleaning liquid with a high degree of contamination, a problem may arise in that since the cleaning effect of the cleaning liquid has dropped, a large amount of cleaning liquid may be needed to complete the cleaning of the entire ink supply element including the supply flow path and discharging head. This may lower the cleaning efficiency.

SUMMARY

According to an aspect of the present disclosure, a method of cleaning a liquid discharging apparatus is provided. The liquid discharging apparatus has a liquid tank that stores a liquid, a discharging head having nozzles from which the liquid is discharged, a supply flow path through which the liquid in the liquid tank is supplied to the discharging head, and a valve disposed in the supply flow path. When, with respect to a direction in which the liquid flows toward the discharging head, a flow path for the liquid, the flow path being disposed upstream of the valve, is taken as a first flow path and a flow path for the liquid, the flow path being disposed downstream of the valve, is taken as a second flow path, the second flow path has a smaller volume than the first flow path. The method includes a second flow path cleaning step of causing a cleaning liquid to pass through the second flow path so that the second flow path is cleaned, and also includes a first flow path cleaning step of causing the cleaning liquid that has passed through the second flow path to pass through the first flow path so that the first flow path is cleaned.

DESCRIPTION OF EXEMPLARY EMBODIMENTS

A. First Embodiment

Figure 1:
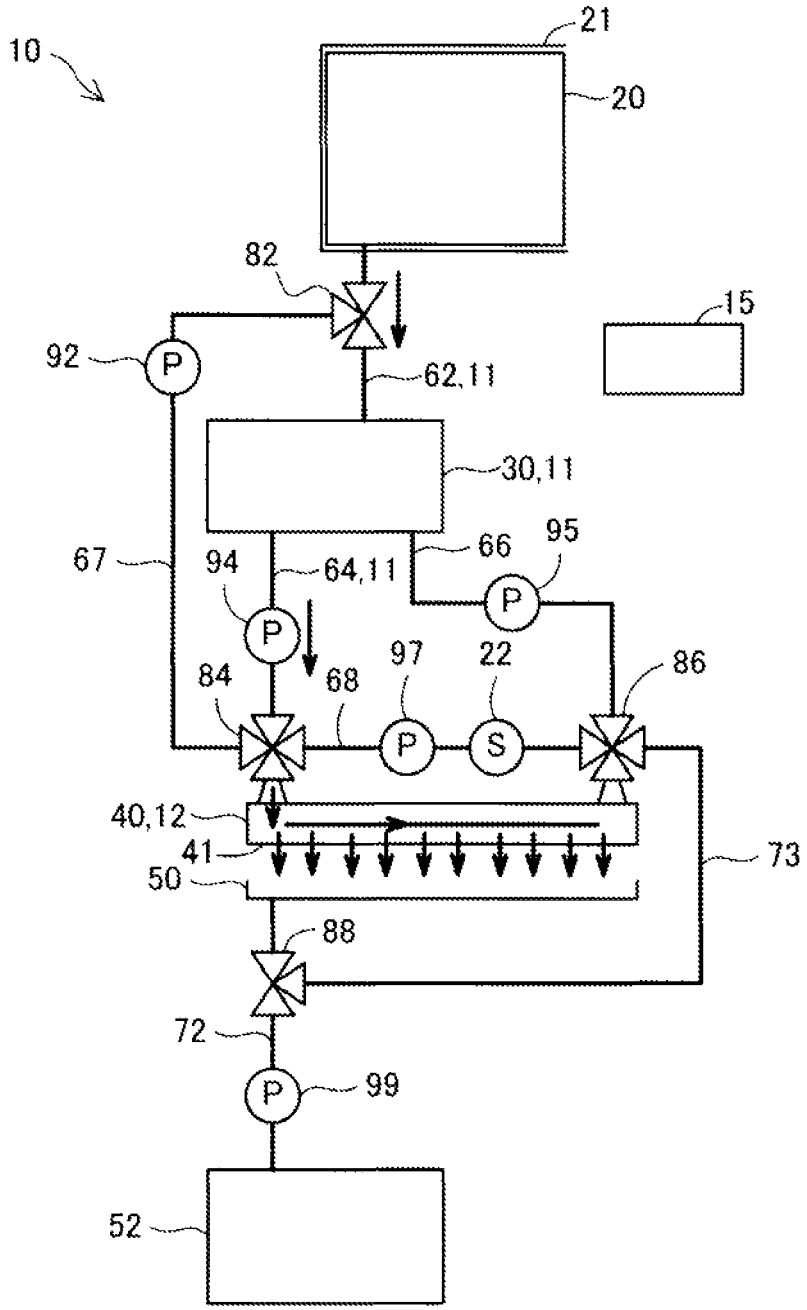
FIG. 1 schematically illustrates a liquid discharging apparatus in a first embodiment of the present disclosure.

FIG. 1 schematically illustrates a liquid discharging apparatus 10 in a first embodiment of the present disclosure. The liquid discharging apparatus 10, which is an ink jet printer, lands an ink used as a liquid on a medium such as a cloth to print an image such as a pattern. The liquid discharging apparatus 10 has a controller 15, a cleaning tank 20, a cartridge attachment section 21, a liquid tank 30, a discharging head 40, a cap 50, and a waste water tank 52. In the present disclosure, the upstream and downstream are determined with respect to a direction in which a liquid flows toward the discharging head 40.

The controller 15 controls the operation of the liquid discharging apparatus 10. For example, the controller 15 controls the operation of the discharging head 40 to control a print operation, and also controls pumps and valves described later to control an operation in cleaning processing.

The cleaning tank 20 stores a cleaning liquid to be used to clean flow paths through which a liquid used in the liquid discharging apparatus 10 flows. Any of various liquids can be used as the cleaning liquid as long as the liquid can remove the residual ink remaining in the flow paths. For example, water or water including a surfactant can be used as the cleaning liquid.

The cartridge attachment section 21 can detachably accommodate a cartridge, which stores an ink as a liquid to be discharged from the discharging head 40. The cartridge attachment section 21 can also detachably accommodate the cleaning tank 20. The flow paths are cleaned when the need arises to change the type of the cartridge attached in the cartridge attachment section 21. For example, when a cartridge storing an ink in a different color or an ink having a different composition needs to be attached instead of the currently attached cartridge, the flow paths are cleaned are cleaned. After the flow paths have been cleaned, the cleaning tank 20 is removed from the cartridge attachment section 21 and a new cartridge is attached in the cartridge attachment section 21.

The liquid tank 30 is a sub-tank that stores a liquid used for printing. The liquid tank 30 is disposed downstream of the cleaning tank 20 and upstream of the discharging head 40. For example, the liquid tank 30 is disposed above the discharging head 40. The liquid tank 30 communicates with the cleaning tank 20 and cartridge, which are attached in the cartridge attachment section 21. The liquid tank 30 can store a liquid supplied from the cleaning tank 20 or cartridge. The liquid tank 30 also communicates with the discharging head 40, so the liquid tank 30 can supply the liquid stored in it to the discharging head 40. The liquid tank 30 has a storage chamber that stores a liquid as well as an air hole through which the storage chamber communicates with the atmosphere.

The discharging head 40 has a common liquid chamber through which the liquid in the liquid tank 30 flows, a plurality of pressure chambers branching from the common liquid chamber, and a plurality of nozzles, each of which communicates with the relevant pressure chamber. A piezoelectric element and a vibrating plate are provided on a wall, which is part of each pressure chamber. A liquid is discharged from each nozzle. During printing, the piezoelectric element is driven to deform the vibrating plate. Thus, the liquid stored in the pressure chamber is forced to flow toward the nozzle and is discharged from the nozzle. The opening in the nozzle is formed in the nozzle surface 41 of the discharging head 40, the nozzle surface 41 facing a medium. The discharging head 40 is supported by a carriage (not illustrated). During printing, the carriage bidirectionally moves in a main scanning direction.

The cap 50 is used during the cleaning of the flow paths in the liquid discharging apparatus 10 or normal cleaning of the discharging head 40. Normal cleaning is processing to discharge, from the discharging head 40, bubbles generated in the discharging head 40 or a liquid that has become viscous. The cap 50 is structured so that it can be moved by an actuator. The cap 50, which is shaped in a concave form, can form a sealed space when the cap 50 is brought into tight contact with the nozzle surface 41 so as to cover the openings in the nozzles. The inside of the concave shape of the cap 50 communicates with the waste water tank 52. During the cleaning of the flow paths, the cap 50 accepts the liquid discharged from the nozzles in the discharging head 40 and exhausts the liquid to the waste water tank 52.

The waste water tank 52 communicates with the cap 50. The waste water tank 52 can store the liquid exhausted to the cap 50.

In addition, the liquid discharging apparatus 10 has a coupling flow path 62, a supply flow path 64, a circulation flow path 66, a first cleaning flow path 67, a second cleaning flow path 68, a first waste water flow path 72, and a second waste water flow path 73.

The coupling flow path 62 couples the liquid tank 30 and the cleaning tank 20 and cartridge attached in the cartridge attachment section 21 together. The coupling flow path 62 is formed from a tube.

The supply flow path 64 is used to supply the liquid in the liquid tank 30 to the discharging head 40. The supply flow path 64 couples the liquid tank 30 and discharging head 40 together. The circulation flow path 66 couples the liquid tank 30 and discharging head 40 together through a different route from the supply flow path 64.

The first cleaning flow path 67 couples the coupling flow path 62 and discharging head 40 together. The second cleaning flow path 68 couples the first cleaning flow path 67 and second waste water flow path 73 together. The first waste water flow path 72 couples the cap 50 and waste water tank 52 together. The second waste water flow path 73 couples the second cleaning flow path 68 and first waste water flow path 72 together, and also couples the circulation flow path 66 and first waste water flow path 72 together.

In addition, the liquid discharging apparatus 10 has a first pump 92, a second pump 94, a third pump 95, a fourth pump 97, a fifth pump 99, and a contamination degree sensor 22. The first pump 92 is disposed in the first cleaning flow path 67. The second pump 94 is disposed in the supply flow path 64. The third pump 95 is disposed in the circulation flow path 66. The fourth pump 97 is disposed n the second cleaning flow path 68. The fifth pump 99 is disposed in the first waste water flow path 72. The contamination degree sensor 22 is disposed in the second cleaning flow path 68. The contamination degree sensor 22 detects a contamination degree that indicates the extent to which a liquid, such as a cleaning liquid, that passes through the second cleaning flow path 68 is dirtied. A detection result is transmitted to the controller 15. The controller 15 may display the detection result on a monitor (not illustrated). The contamination degree sensor 22 is, for example, an optical sensor that can detect the transmittance of a liquid. In this case, the transmittance is an index for the degree of contamination. The lower the transmittance is, the higher the degree of contamination is.

In addition, the liquid discharging apparatus 10 has a first valve 82, a second valve 84, a third valve 86, and a fourth valve 88 that switch the open/closed states and communication states of the flow paths 62, 64, 66, 67, 68, 72, and 73. The first valve 82, second valve 84, third valve 86, and fourth valve 88 may be each an automatic valve, which is electrically driven, or may be a manual valve.

The first valve 82 is disposed at a location at which the first cleaning flow path 67 branches from the coupling flow path 62. When the opening and closing of three ports of the first valve 82 are controlled by its valve body, the first valve 82 can switch the open/closed state of the coupling flow path 62 and the state of communication between the coupling flow path 62 and the first cleaning flow path 67.

The second valve 84 is disposed at a location at which the first cleaning flow path 67, supply flow path 64, second cleaning flow path 68, and discharging head 40 join together. When the opening and closing of four ports of the second valve 84 are controlled by its valve body, the second valve 84 can switch the open/closed states and communication states of the first cleaning flow path 67, discharging head 40, supply flow path 64, and second cleaning flow path 68, which are coupled to the four ports. Although the second valve 84, which functions as a valve, is disposed at the downstream end of the supply flow path 64, this is not a limitation. The second valve 84 only needs to be disposed in the supply flow path 64.

The third valve 86 is disposed at a location at which the circulation flow path 66, second cleaning flow path 68, discharging head 40, and second waste water flow path 73 join together. When the opening and closing of four ports of the third valve 86 are controlled by its valve body, the third valve 86 can switch the open/closed states and communication states of the circulation flow path 66, second cleaning flow path 68, discharging head 40, and second waste water flow path 73, which are coupled to the four ports.

The fourth valve 88 is disposed at a location at which the second waste water flow path 73 is coupled to the first waste water flow path 72. When the opening and closing of three ports of the fourth valve 88 are controlled by its valve body, the fourth valve 88 can switch the open/closed states and communication states of the first waste water flow path 72 and second waste water flow path 73.

In a normal operation in which the liquid discharging apparatus 10 performs printing, the first cleaning flow path 67, second cleaning flow path 68, circulation flow path 66, and second waste water flow path 73, which are not used for printing, may be removed from the liquid discharging apparatus 10. Here, of the flow paths through which a liquid is supplied from a cartridge (not illustrated) attached in the cartridge attachment section 21 to the nozzles in the discharging head 40 during printing by the liquid discharging apparatus 10, the flow paths disposed upstream of the second valve 84 will be referred to as a first flow path 11 and the flow paths disposed downstream of the second valve 84 will be referred to as a second flow path 12. The first flow path 11 includes the coupling flow path 62, liquid tank 30, and supply flow path 64. The second flow path 12 is the discharging head 40. The second flow path 12 has a smaller volume than the first flow path 11.

In a normal operation in which the liquid discharging apparatus 10 discharges a liquid to a medium, the liquid in the cartridge (not illustrated) attached in the cartridge attachment section 21 is supplied to the discharging head 40 through the coupling flow path 62, liquid tank 30, and supply flow path 64 as indicated by the orientations of the arrows in FIG. 1. The controller 15 discharges the liquid from the nozzles in the discharging head 40 to execute printing.

Figure 2:
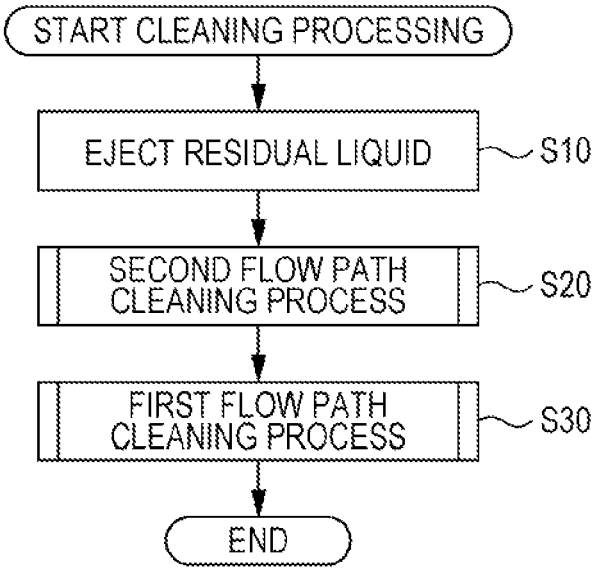
FIG. 2 is a flowchart for cleaning processing in the first embodiment.
Figure 3:
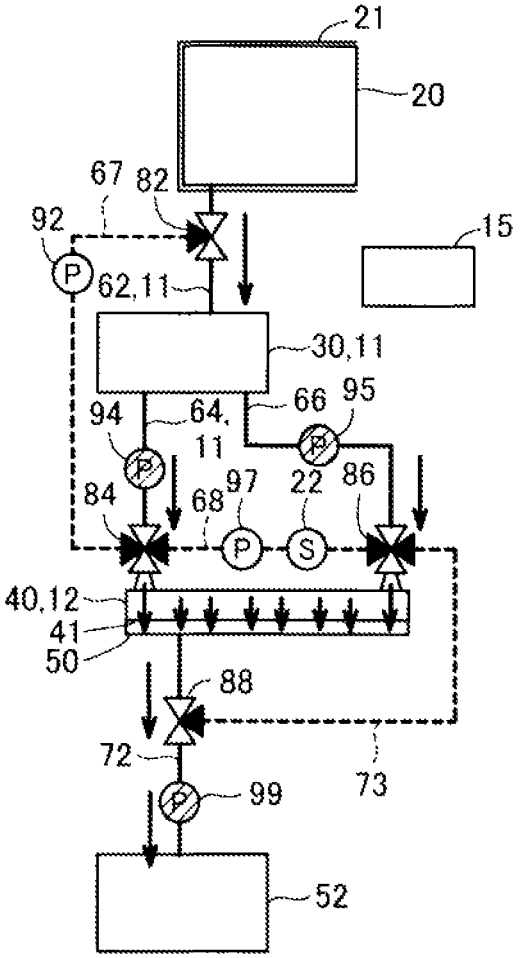
FIG. 3 is a drawing used to explain step S10.

FIG. 2 is a flowchart for cleaning processing in the first embodiment. FIG. 3 is a drawing used to explain step S10. In FIG. 3, the orientations of the arrows indicate a direction in which a liquid flows. Also in FIG. 3, the solid-black ports of the valves 82 to 88 indicate that these ports are closed, and the outline ports of these valves indicate that these ports are open. Also in FIG. 3, some of the pumps 92 to 99 are hatched; the hatched pumps are operating. Also in FIG. 3, flow paths through which a cleaning liquid is flowing are indicated by solid lines, and flow paths through which the cleaning liquid is not flowing are indicated by dotted lines. Cleaning processing is performed after the cleaning tank 20 is attached in the cartridge attachment section 21.

As indicated in FIG. 2, the controller 15 ejects a residual liquid in step S10. Step S10 is executed when, for example, the user commands, through a monitor or the like, the liquid discharging apparatus 10 to perform processing to discharge the residual liquid with a motor or the like. In processing to discharge the residual liquid, the controller 15 seals the nozzle surface 41 with the cap 50, as illustrated in FIG. 3. The controller 15 also controls the operations of the first valve 82 to the fourth valve 88 so that the coupling flow path 62 is placed in a communication state, the supply flow path 64 and discharging head 40 mutually communicate, and the circulation flow path 66 and discharging head 40 mutually communicate. Next, the controller 15 drives the fifth pump 99 to suck the residual ink remaining in the first flow path 11 and second flow path 12 through the cap 50. The sucked ink is ejected to the waste water tank 52. Step S10 is terminated at the point in time at which the liquid has been ejected by at least an amount equal to the sum of the volume of the first flow path 11 and the volume of the second flow path 12.

Referring again to FIG. 2, after step S10, a second flow path cleaning process is executed in step S20. In the second flow path cleaning process, a cleaning liquid is caused to pass through the discharging head 40, which is the second flow path 12, without passing through the liquid tank 30 so that the second flow path 12 is cleaned. After step S20, a first flow path cleaning process is executed in step S30. In the first flow path cleaning process, the cleaning liquid that has passed through the second flow path 12 to clean the second flow path 12 is caused to pass through the first flow path 11 so that the first flow path 11 is cleaned.

Figure 4:
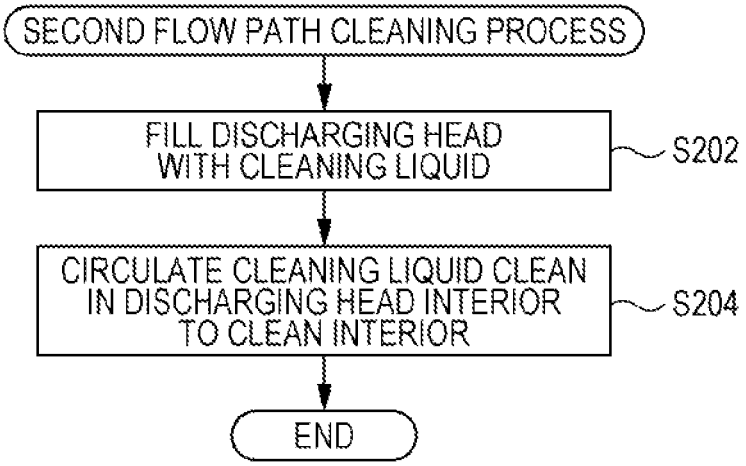
FIG. 4 is a first flowchart for a second flow path cleaning process.
Figure 5:
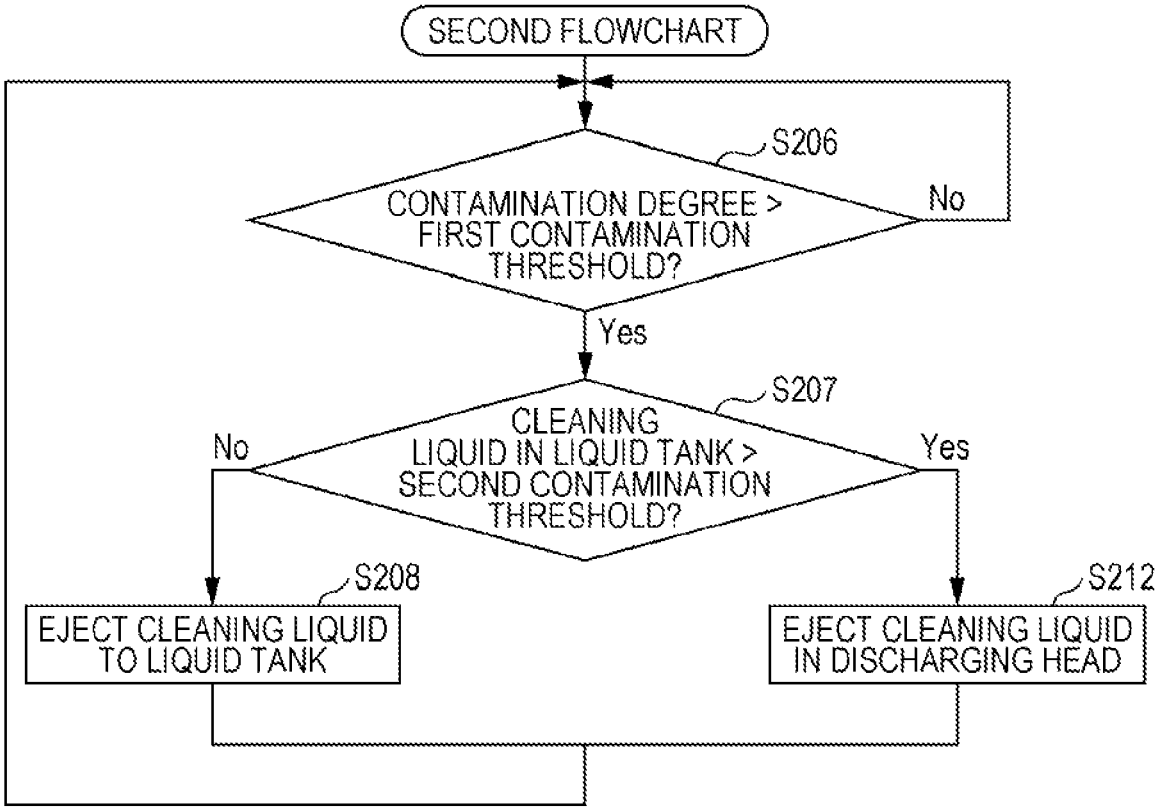
FIG. 5 is a second flowchart for the second flow path cleaning process.
Figure 6B:
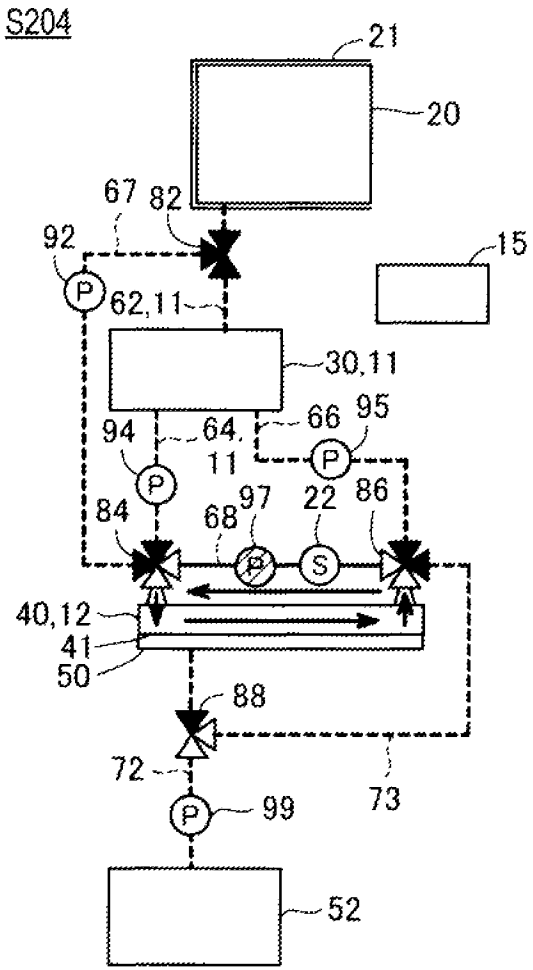
FIGS. 6A and 6B are first drawings used to explain the second flow path cleaning process.
Figure 6A:
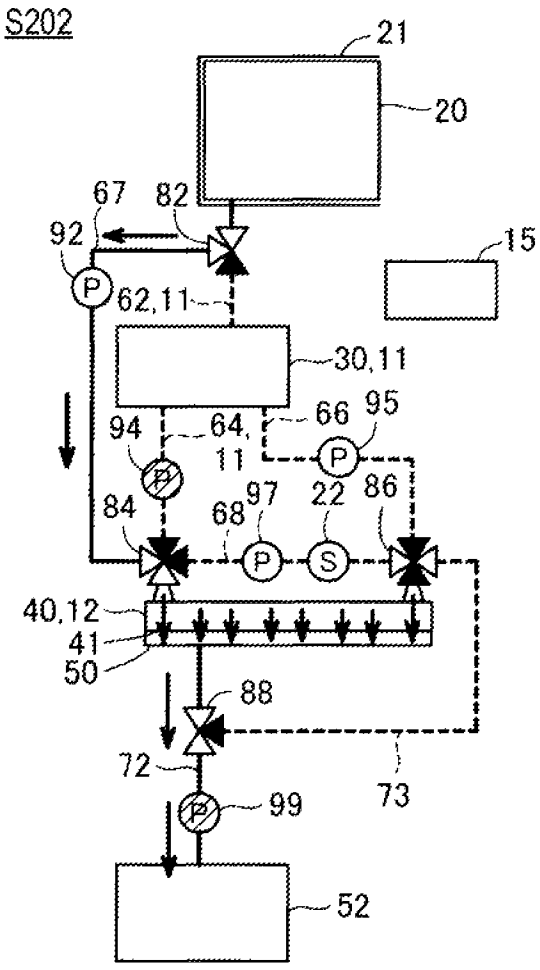
Figure 7B:
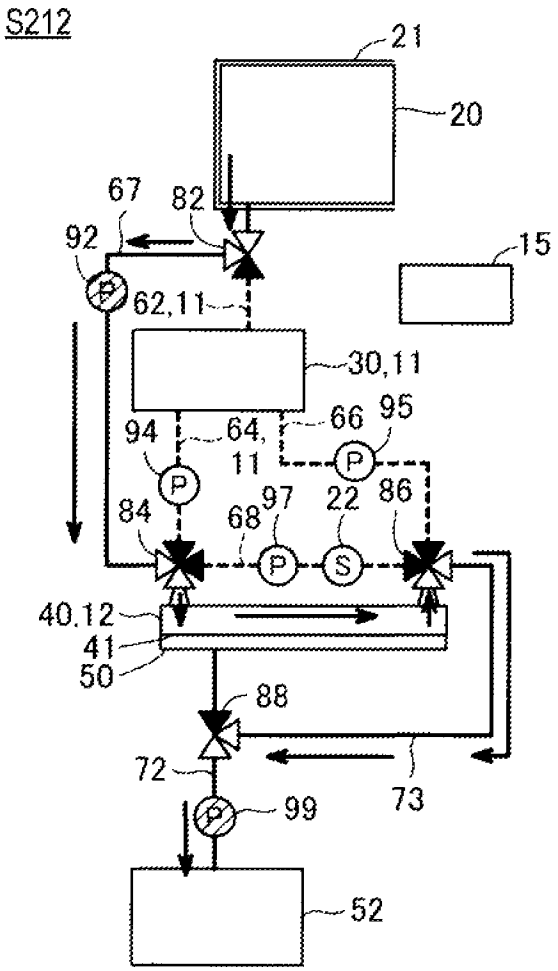
FIGS. 7A and 7B are second drawings used to explain the second flow path cleaning process.
Figure 7A:
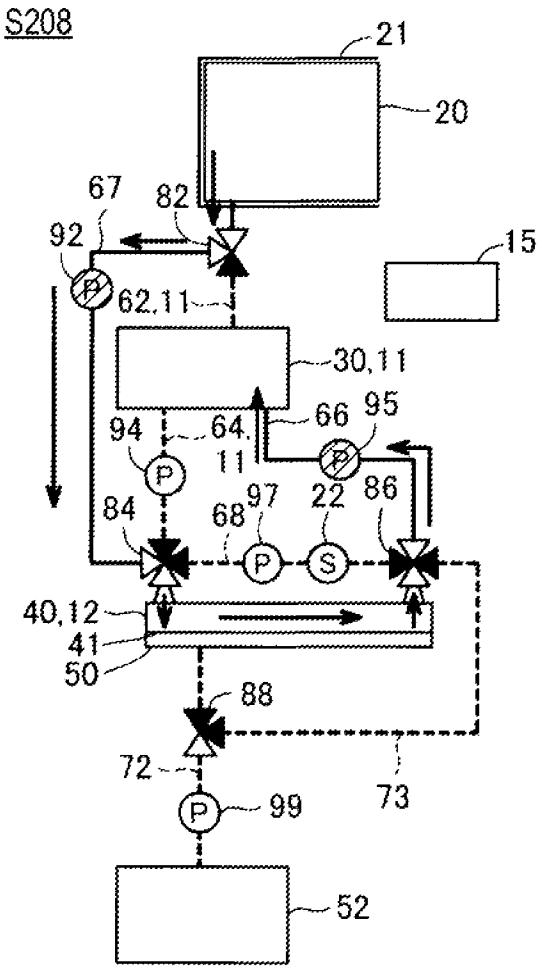

FIG. 4 is a first flowchart for the second flow path cleaning process. FIG. 5 is a second flowchart for the second flow path cleaning process. FIGS. 6A and 6B are first drawings used to explain the second flow path cleaning process. FIGS. 7A and 7B are second drawings used to explain the second flow path cleaning process. In FIGS. 6A and 6B and FIGS. 7A and 7B, the orientations of the arrows indicate a direction in which a liquid flows. Also in FIGS. 6A and 7B and FIGS. 7A and 7B, the solid-black ports of the valves 82 to 88 indicate that these ports are closed, and the outline ports of these valves indicate that these ports are open. Also in FIGS. 6A and 7B and FIGS. 7A and 7B, some of the pumps 92 to 99 are hatched; the hatched pumps are operating. Also in FIGS. 6A and 7B and FIGS. 7A and 7B, flow paths through which a cleaning liquid is flowing are indicated by solid lines, and flow paths through which the cleaning liquid is not flowing are indicated by dotted lines.

In the second flow path cleaning process, the discharging head 40, which is the first flow path 11, is filled with a cleaning liquid in step S202, as indicated in FIG. 4. In step S202, the controller 15 controls the operations of the first valve 82 to the fourth valve 88 and the operations of the first pump 92 to the fifth pump 99. Thus, the cleaning liquid in the cleaning tank 20 is supplied to the discharging head 40 without passing through the liquid tank 30, as illustrated in FIG. 6A. Thus, in step S202, the cleaning liquid in the cleaning tank 20 passes through the first cleaning flow path 67 and is supplied to the discharging head 40. Step S202 is terminated when the cleaning liquid has been supplied to the discharging head 40 by an amount equal to the volume of the discharging head 40.

Referring again to FIG. 4, in step S204 following S202, the controller 15 causes the cleaning liquid to circulate in the discharging head 40 so that its interior is cleaned. Specifically, the controller 15 drives the fourth pump 97 to circulate the cleaning liquid between the discharging head 40 and the second cleaning flow path 68 as illustrated in FIG. 6B. Processing in step S204 and the subsequent steps is terminated at the point in time at which step S204 has been executed for a predetermined length of time, beginning from the start of step S204.

The controller 15 repeatedly executes all steps in FIG. 5 from when step S204 starts until it is terminated. The controller 15 first decides in step S206 whether the contamination degree indicated by a detection result from the contamination degree sensor 22 is higher than a first contamination threshold. When the decision result in step S206 is No, step S206 is repeatedly executed.

When the decision result in step S206 is Yes, the controller 15 decides in step S207 whether the amount of cleaning liquid stored in the liquid tank 30 is larger than a second tank threshold. In step S207, to infer the amount of cleaning liquid stored in the liquid tank 30, the controller 15 calculates the amount of cleaning liquid that has been supplied to the liquid tank 30 from, for example, the amount of cleaning liquid fed by the third pump 95 and a time during which the cleaning liquid was being fed. When the liquid tank 30 has a liquid surface sensor, the amount of cleaning liquid may be inferred from a detection result from the liquid surface sensor instead of the above inference.

When the decision result in step S207 is No, the controller 15 ejects the cleaning liquid in use for circulation cleaning to the liquid tank 30 in step S208. Specifically, the controller 15 controls the operations of the first pump 92 to the fifth pump 99 and the operations of the first valve 82 to the fourth valve 88 as illustrated in FIG. 7A, and executes step S208. In step S208, the cleaning liquid in the cleaning tank 20 is supplied to the discharging head 40 through the first cleaning flow path 67, so the cleaning liquid in the discharging head 40 is forced to flow out, passes through the circulation flow path 66, and is supplied to the liquid tank 30. After step S208, step S206 is executed again. While step S208 is being executed, step S204 indicated in FIG. 4 is temporarily stopped.

When the decision result in step S207 is Yes, the controller 15 ejects the cleaning liquid in the discharging head 40 to the waste water tank 52 in step S212. Specifically, the controller 15 controls the operations of the first pump 92 to the fifth pump 99 and the operations of the first valve 82 to the fourth valve 88 as illustrated in FIG. 7B, and supplies the cleaning liquid in the cleaning tank 20 to the discharging head 40 through the first cleaning flow path 67. Accordingly, the cleaning liquid in the discharging head 40 is forced to flow out and is ejected to the waste water tank 52, so the contamination degree of the cleaning liquid in the discharging head 40 can be lowered. After step S212, step S206 is executed again. While step S212 is being executed, step S204 indicated in FIG. 4 is temporarily stopped.

Figure 8:
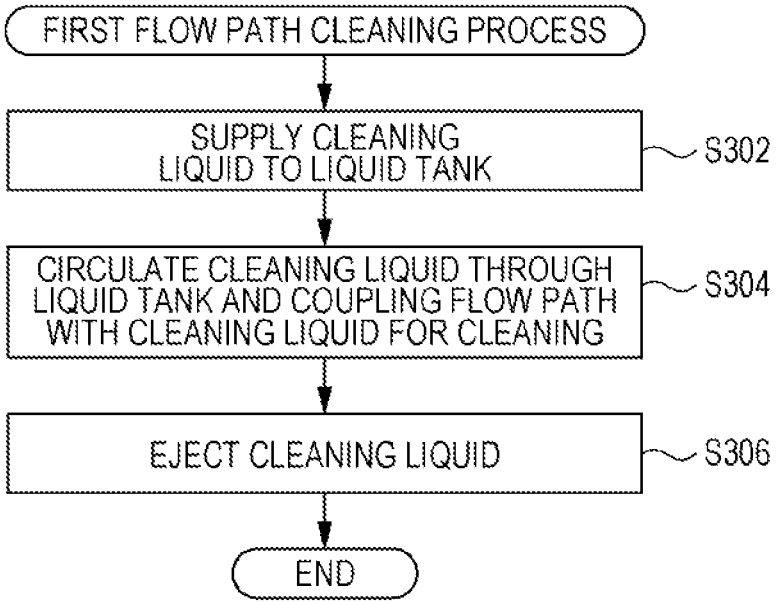
FIG. 8 is a flowchart for a first flow path cleaning process.
Figure 9A:
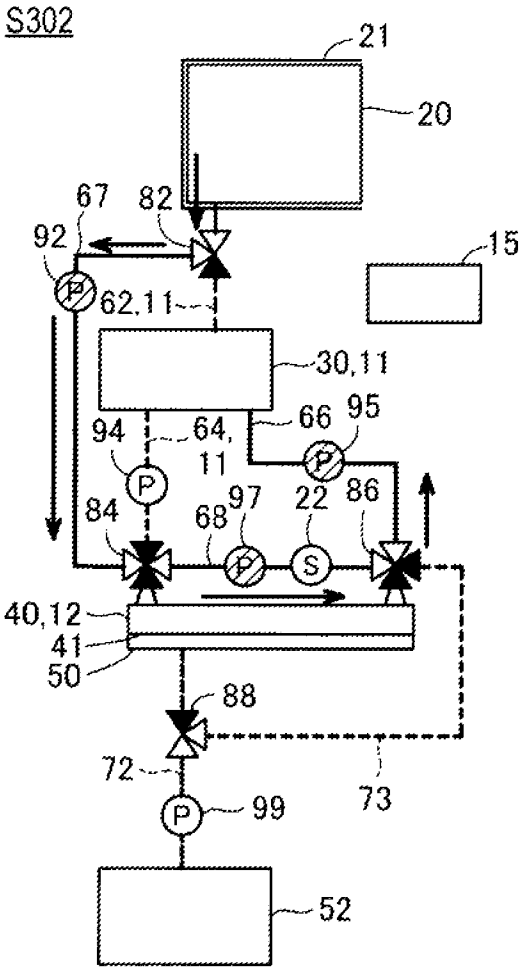
FIGS. 9A to 9C are drawings used to explain the first flow path cleaning process.
Figure 9B:
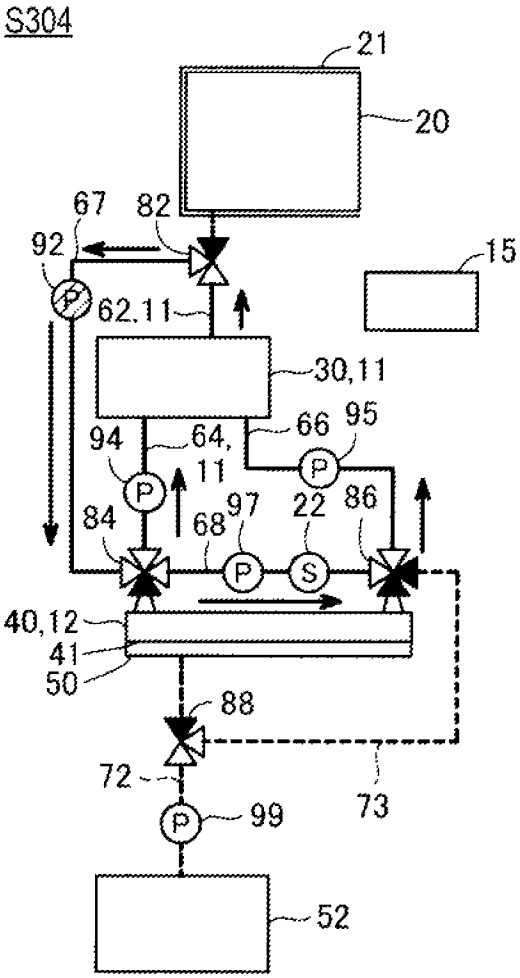
Figure 9C:
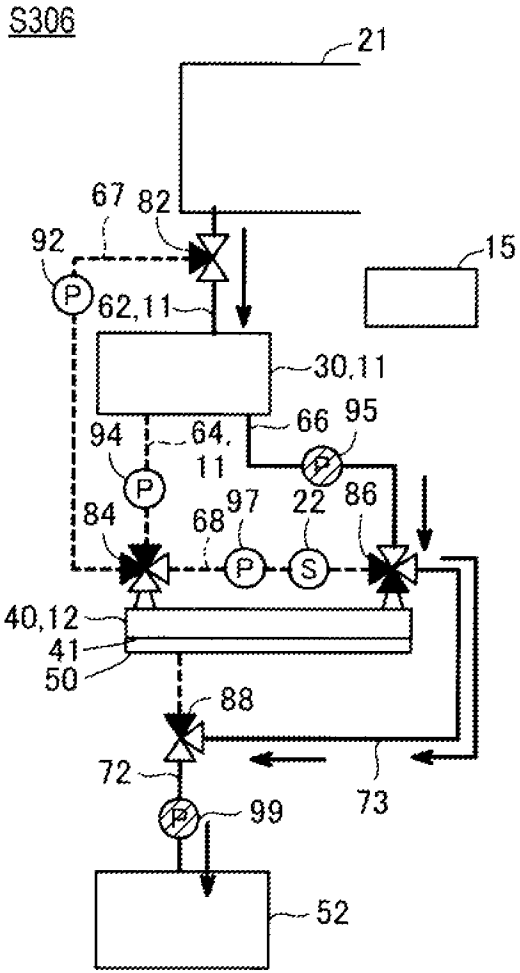

FIG. 8 is a flowchart for the first flow path cleaning process. FIGS. 9A to 9C are drawings used to explain the first flow path cleaning process. In FIGS. 9A to 9C, the orientations of the arrows indicate a direction in which a liquid flows. Also in FIGS. 9A to 9C, the solid-black ports of the valves 82 to 88 indicate that these ports are closed, and the outline ports of these valves indicate that these ports are open. Also in FIGS. 9A to 9C, some of the pumps 92 to 99 are hatched; the hatched pumps are operating. Also in FIGS. 9A to 9C, flow paths through which a cleaning liquid is flowing are indicated by solid lines, and flow paths through which the cleaning liquid is not flowing are indicated by dotted lines.

In the first flow path cleaning process in step S30, the controller 15 first supplies the cleaning liquid in the cleaning tank 20 to the liquid tank 30 by a predetermined amount in step S302, as illustrated in FIG. 8. Specifically, the controller 15 controls the operations of the first pump 92 to the fifth pump 99 and the operations of the first valve 82 to the fourth valve 88 as illustrated in FIG. 9A, and supplies the cleaning liquid in the cleaning tank 20 to the liquid tank 30 through the first cleaning flow path 67, second cleaning flow path 68, and circulation flow path 66.

Referring again to FIG. 8, in step S304 following S302, the controller 15 circulates the cleaning liquid through the liquid tank 30 and coupling flow path 62 for a predetermined length of time to clean them. Specifically, the controller 15 controls the operations of the first pump 92 to the fifth pump 99 and the operations of the first valve 82 to the fourth valve 88 as illustrated in FIG. 9B, and circulates the cleaning liquid among the first cleaning flow path 67, supply flow path 64, second cleaning flow path 68, circulation flow path 66, liquid tank 30, and coupling flow path 62.

Referring again to FIG. 8, in step S306 following S304, the controller 15 ejects the cleaning liquid that has been circulated in step S304 to the waste water tank 52. Specifically, after the cleaning tank 20 has been removed from the cartridge attachment section 21, the controller 15 controls the operations of the first pump 92 to the fifth pump 99 and the operations of the first valve 82 to the fourth valve 88 as illustrated in FIG. 9C, and ejects the cleaning liquid in the coupling flow path 62 and liquid tank 30 to the waste water tank 52 through the circulation flow path 66, second waste water flow path 73, and first waste water flow path 72. This terminates the first flow path cleaning process.

Upon the termination of the first flow path cleaning process, the user attaches a new cartridge in the cartridge attachment section 21. When a new cartridge is attached in the cartridge attachment section 21, the controller 15 executes initial supply processing before executing printing. In initial supply processing, the liquid in the cartridge is supplied to the liquid tank 30 through the coupling flow path 62 and is further supplied to the interior of the discharging head 40 through the supply flow path 64. After initial supply processing, the liquid discharging apparatus 10 become ready for execution of a printing operation.

In the first embodiment described above, the second flow path 12 has a smaller volume than the first flow path 11, so the contamination degree of the cleaning liquid used in the second flow path cleaning process in step S20 is relatively low. Therefore, according to the cleaning method in which cleaning processing in the first embodiment above is used, the cleaning liquid that has been used to clean the second flow path 12 is used to clean the first flow path 11 in step S30, the contamination degree of the cleaning liquid being relatively low, so the cleaning liquid can be efficiently used. Thus, it is possible to suppress a drop in cleaning efficiency. In particular, when the liquid discharging apparatus 10 is an industrial ink jet printer, a large medium is used, so a distance over which a carriage (not illustrated), which supports the discharging head 40, bidirectionally moves also becomes long. In view of this, the length of the supply flow path 64 is designed so as to be long, so much more cleaning liquid is needed to clean the interior of the supply flow path 64. In this embodiment, however, since the cleaning liquid that has been used in the second flow path cleaning process is used to clean the first flow path 11 including the supply flow path 64, the amount of cleaning liquid to be used can be reduced.

In the second flow path cleaning process in the first embodiment described above, when the contamination degree of the cleaning liquid in use for the cleaning of the second flow path 12 is higher than the first threshold, the cleaning liquid in use for the cleaning of the second flow path 12 is ejected to the liquid tank 30 as indicated in steps S206 and S208 in FIG. 5. The cleaning liquid ejected to the liquid tank 30 is used for cleaning in the first flow path cleaning process. Thus, the cleaning liquid can be effectively used.

B. Second Embodiment

Figure 10:
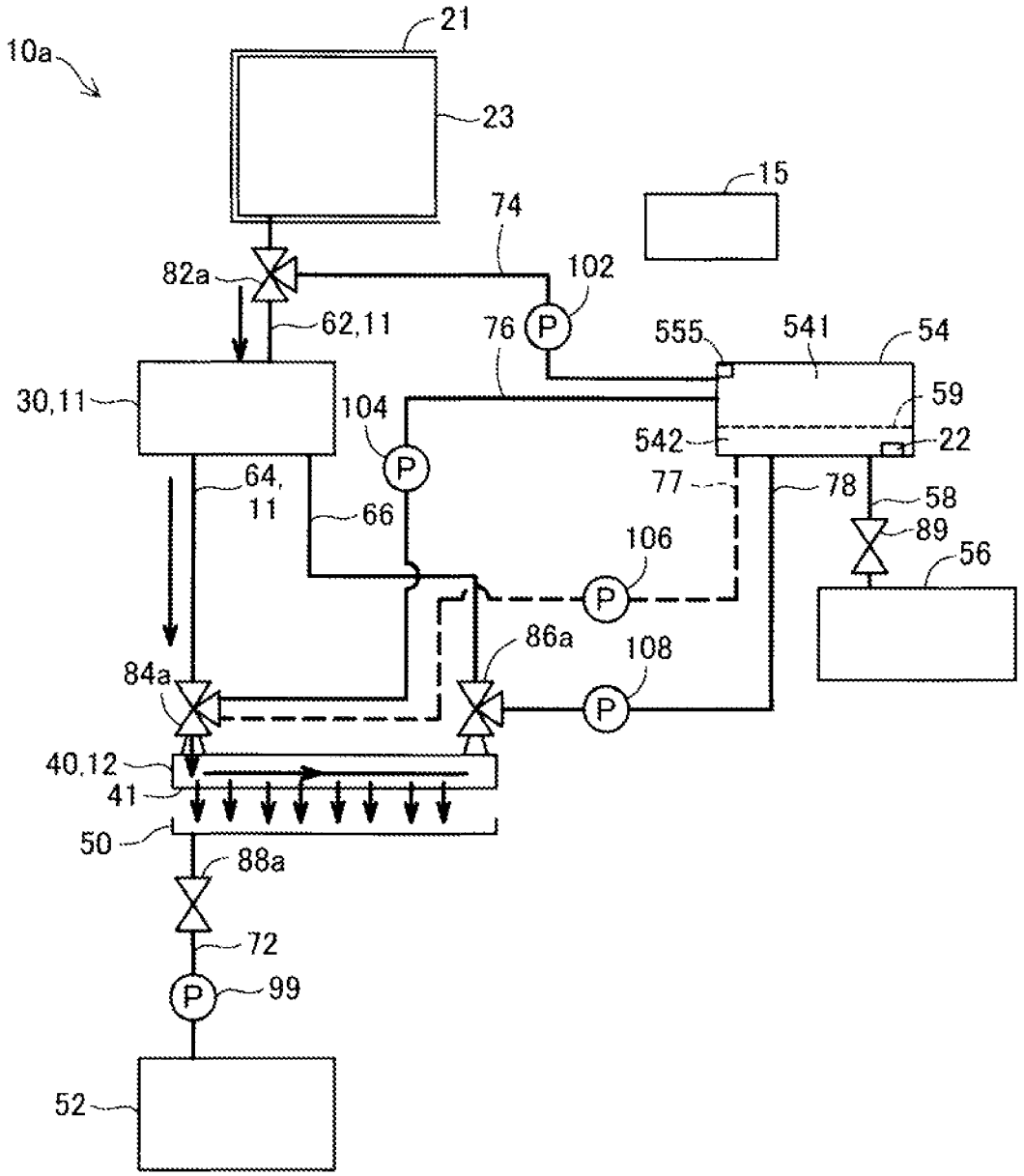
FIG. 10 schematically illustrates a liquid discharging apparatus in a second embodiment of the present disclosure.

FIG. 10 schematically illustrates a liquid discharging apparatus 10*a* in a second embodiment of the present disclosure. Constituent components of the liquid discharging apparatus 10*a* in this embodiment that are the same as with the liquid discharging apparatus 10, illustrated in FIG. 1, in the first embodiment will be given the same reference numerals, and descriptions will be omitted. In the liquid discharging apparatus 10*a* illustrated in FIG. 10, a cartridge 23 that stores a liquid used in printing is attached in the cartridge attachment section 21.

The liquid discharging apparatus 10*a* further has an external waste water tank 56 and a cleaning tank 54, which is disposed at a place different from the place of the cartridge attachment section 21. The cleaning tank 54 stores a cleaning liquid as with the cleaning tank 20 in the first embodiment.

The cleaning tank 54 has the contamination degree sensor 22, a filter 59, and a liquid surface sensor 555. The filter 59 captures fixtures and other foreign matter. The filter 59 divides the interior of the cleaning tank 54 into a first chamber 541 and a second chamber 542. The liquid surface sensor 555 detects the amount of cleaning liquid, which a liquid stored in the cleaning tank 54. Specifically, the liquid surface sensor 555 detects the water level of the cleaning liquid in the cleaning tank 54. A result of detection by the liquid surface sensor 555 is transmitted to the controller 15. The external waste water tank 56 stores the cleaning liquid ejected from the cleaning tank 54.

The liquid discharging apparatus 10*a* further has a first external flow path 74, a second external flow path 76, a third external flow path 77, a fourth external flow path 78, and an external waste water flow path 58. The flow paths 74, 76, 77, and 58 are used when the liquid discharging apparatus 10*a* is cleaned with a cleaning liquid. The flow paths 74, 76, 77, and 58 are formed from, for example, a tube. The liquid discharging apparatus 10*a* may lack the circulation flow path 66.

The first external flow path 74 couples the coupling flow path 62 and first chamber 541 together. The second external flow path 76 couples the first chamber 541 and supply flow path 64 together. The third external flow path 77 couples the second chamber 542 and supply flow path 64 together. The fourth external flow path 78 couples the second chamber 542, circulation flow path 66, and discharging head 40 together. The external waste water flow path 58 couples the second chamber 542 and external waste water tank 56 together. The second external flow path 76 and third external flow path 77 are removable and are selectively used. For example, when the second external flow path 76 is used, the third external flow path 77 is removed; when the third external flow path 77 is used, the second external flow path 76 is removed.

The liquid discharging apparatus 10*a* further has a first external pump 102, a second external pump 104, a third external pump 106, and a fourth external pump 108. The first external pump 102 is disposed in the first external flow path 74. The second external pump 104 is disposed in the second external flow path 76. The third external pump 106 is disposed in the third external flow path 77. The fourth external pump 108 is disposed in the fourth external flow path 78.

The liquid discharging apparatus 10*a* further has a first valve 82*a*, a second valve 84*a*, a third valve 86*a*, a fourth valve 88*a*, and a first external valve 89, that switch the open/closed states and communication states of the flow paths 62, 64, 66, 74, 76, 77, 78, and 58. The first valve 82*a*, second valve 84*a*, third valve 86*a*, fourth valve 88*a*, and first external valve 89 may be each an automatic valve, which is electrically driven, or may be each a manual valve.

The first valve 82*a* is disposed at a location at which the first external flow path 74 branches from the coupling flow path 62. When the opening and closing of three ports of the first valve 82*a* are controlled by its valve body, the first valve 82*a* can switch the open/closed state of the coupling flow path 62 and the state of communication between the coupling flow path 62 and the first external flow path 74.

The second valve 84*a* is disposed at a location at which the supply flow path 64, discharging head 40, and second external flow path 76 join together. It is also possible to remove the second external flow path 76 from the relevant port of the second valve 84*a* and to attach the third external flow path 77 to that port of the second valve 84*a*. When the opening and closing of three ports of the second valve 84*a* are controlled by its valve body, the second valve 84*a* can switch the open/closed states and communication states of the flow paths coupled to the three ports, the flow paths being, for example, the supply flow path 64, discharging head 40, and second external flow path 76. Although the second valve 84*a*, which functions as a valve, is disposed the downstream end of the supply flow path 64, this is not a limitation. The second valve 84*a* only needs to be disposed in the supply flow path 64.

The third valve 86*a* is disposed at a location at which the circulation flow path 66, discharging head 40, and fourth external flow path 78 join together. When the opening and closing of three ports of the third valve 86*a* are controlled by its valve body, the third valve 86*a* can switch the open/closed states and communication states of the circulation flow path 66, discharging head 40, and fourth external flow path 78, which are coupled to the three ports.

The fourth valve 88*a* is a shut-off valve disposed in the first waste water flow path 72. When the opening and closing of the fourth valve 88*a* are controlled, the fourth valve 88*a* can switch the first waste water flow path 72 between its communication state and non-communication state.

The first external valve 89 is a shut-off valve disposed in the external waste water flow path 58. When the opening and closing of the first external valve 89 are controlled, the first external valve 89 can switch the external waste water flow path 58 between its communication state and non-communication state.

In a normal operation in which the liquid discharging apparatus 10*a* performs printing, the circulation flow path 66, first external flow path 74, second external flow path 76, third external flow path 77 and fourth external flow path 78, which are not used for printing, may be removed from the liquid discharging apparatus 10*a*. Here, of the flow paths through which a liquid is supplied to the nozzles in the discharging head 40 during printing by the liquid discharging apparatus 10*a*, the flow paths disposed upstream of the second valve 84*a* will be referred to as the first flow path 11 and the flow paths disposed downstream of the second valve 84*a* will be referred to as the second flow path 12. The first flow path 11 includes the coupling flow path 62, liquid tank 30, and supply flow path 64. The second flow path 12 is the discharging head 40. The second flow path 12 has a shorter flow path length than the first flow path 11. The second flow path 12 has a smaller volume than the first flow path 11.

In a normal operation in which the liquid discharging apparatus 10*a* discharges a liquid to a medium, the liquid in the cartridge 23 is supplied to the discharging head 40 through the coupling flow path 62, liquid tank 30, and supply flow path 64 as indicated by the orientations of the arrows in FIG. 10. The controller 15 discharges the liquid from the nozzles in the discharging head 40 to execute printing.

Figure 11:
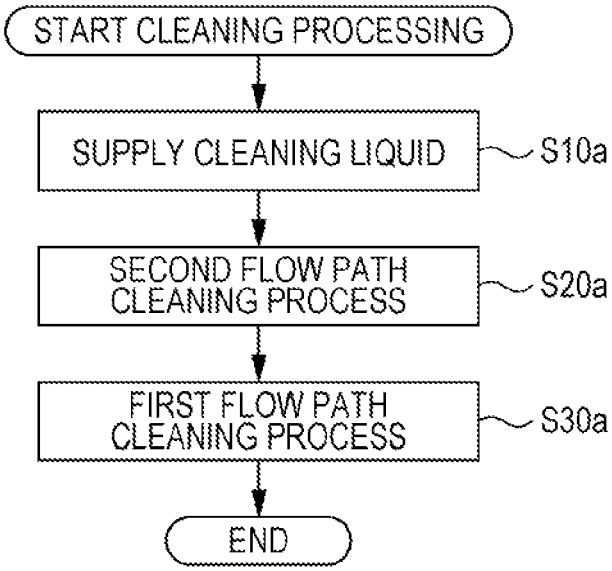
FIG. 11 is a flowchart for cleaning processing in the second embodiment.
Figure 12:
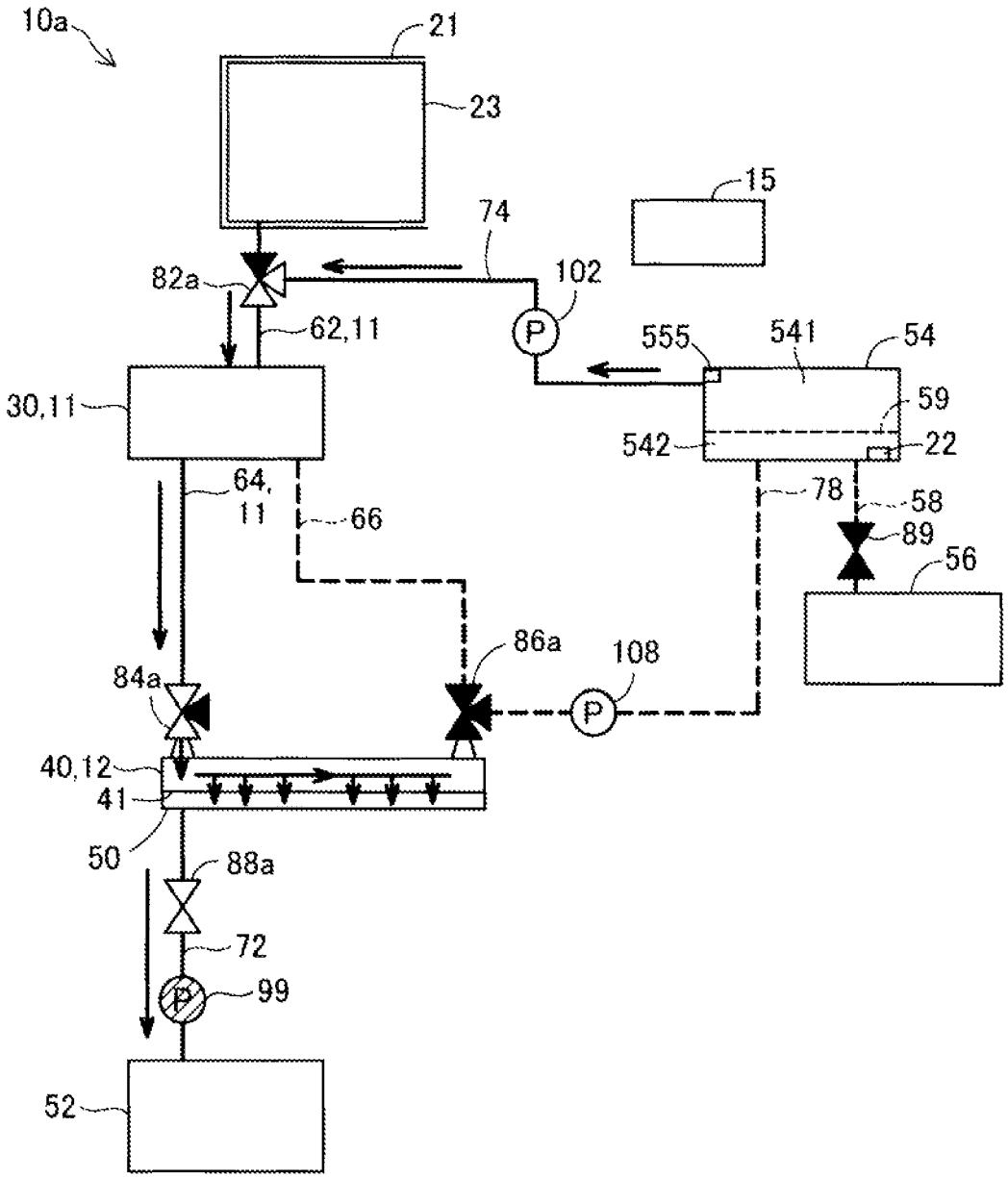
FIG. 12 is a drawing used to explain step S10*a*.
Figure 13:
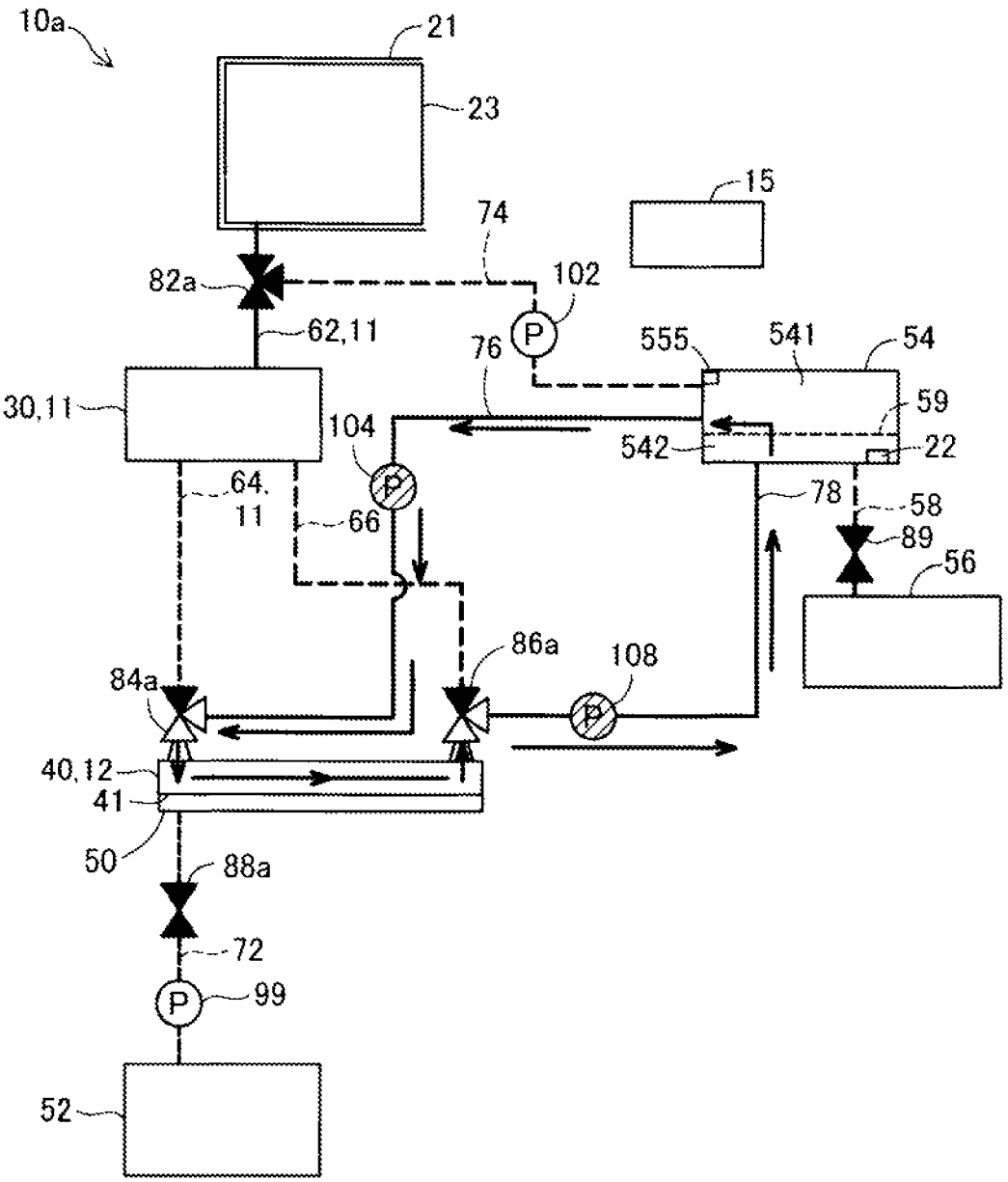
FIG. 13 is a drawing used to explain step S20*a*.
Figure 14:
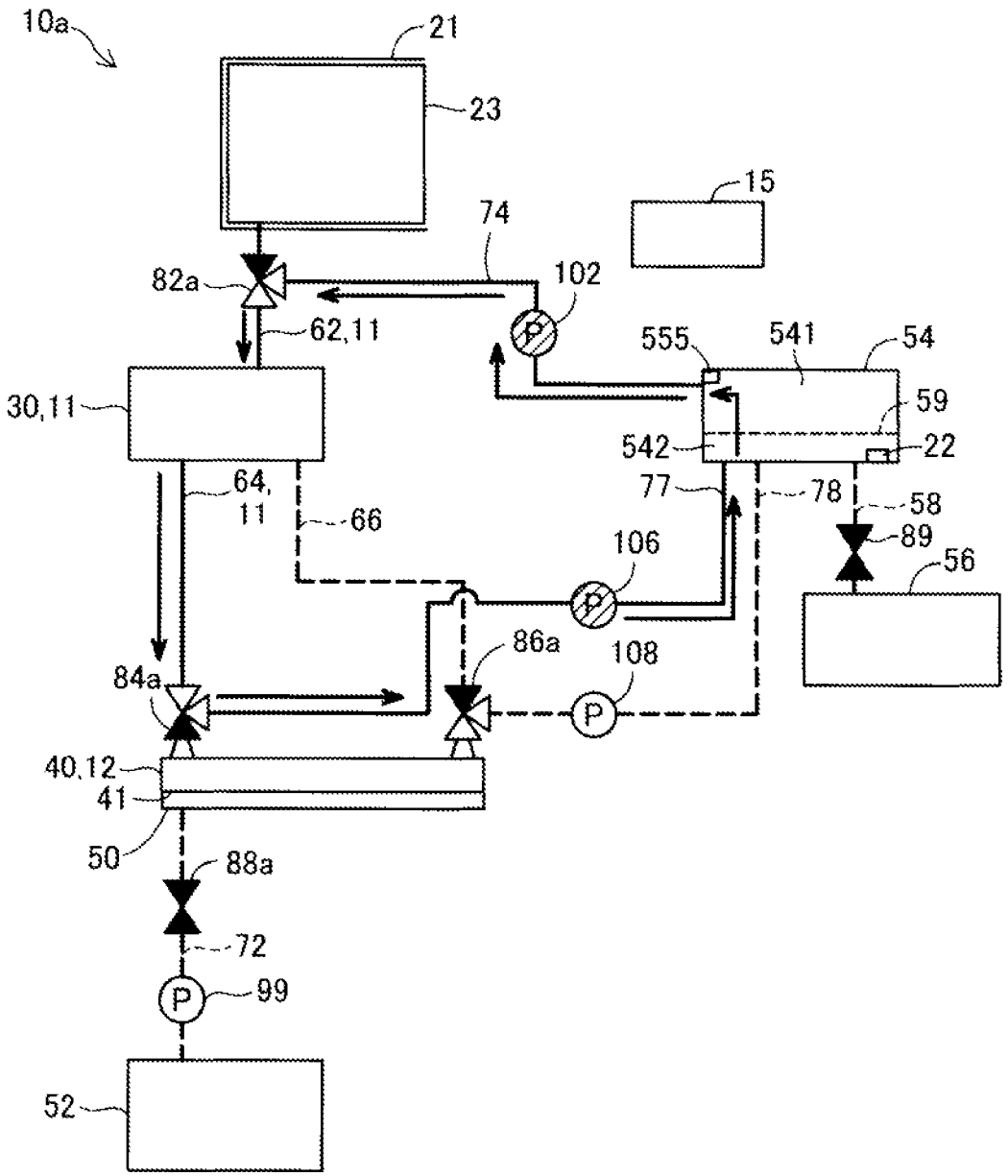
FIG. 14 is a drawing used to explain step S30*a*.

FIG. 11 is a flowchart for cleaning processing in the second embodiment. FIG. 12 is a drawing used to explain step S10*a*. FIG. 13 is a drawing used to explain step S20*a*. FIG. 14 is a drawing used to explain step S30*a*. In FIGS. 12 to 14, the orientations of the arrows indicate a direction in which a liquid flows. Also in FIGS. 12 to 14, the solid-black ports of the valves 82*a*, 84*a*, 86*a*, 88*a*, and 89 indicate that these ports are in the non-communication state, and the outline ports of these valves indicate that these ports are in the communication state. Also in FIGS. 12 to 14, some of the pumps 99, 102, 104, 106, and 108 are hatched; the hatched pumps are operating. Also in FIGS. 12 to 14, flow paths through which a cleaning liquid is flowing are indicated by solid lines, and flow paths through which the cleaning liquid is not flowing are indicated by dotted lines.

As indicated in FIG. 11, the controller 15 supplies the cleaning liquid from the cleaning tank 54 to the first flow path 11 and second flow path 12 in step S10*a*. Thus, the residual ink remaining in the first flow path 11 and second flow path 12 is ejected to the waste water tank 52. In step S10*a*, the controller 15 seals the nozzle surface 41 with the cap 50, as illustrated in FIG. 12. The controller 15 also controls the operations of the first valve 82*a*, second valve 84*a*, and third valve 86*a* so that the first external flow path 74 and coupling flow path 62 mutually communicate and the supply flow path 64 and discharging head 40 mutually communicate. Next, the controller 15 drives the first external pump 102 and fifth pump 99 to supply the cleaning liquid in the cleaning tank 54 so that the residual ink remaining in the first flow path 11 and second flow path 12 is ejected to the waste water tank 52. The controller 15 may execute step S10 in the first embodiment, that is, may drive the fifth pump 99 to such the ink in the first flow path 11 and second flow path 12 and eject the sucked ink to the waste water tank 52 before step S10*a* or instead of step S10*a*.

Referring again to FIG. 11, after step S10*a*, a second flow path cleaning process is executed in step S20*a*. In the second flow path cleaning process, the cleaning liquid is caused to pass through the discharging head 40, which is the second flow path 12, without passing through the first flow path 11 including liquid tank 30 so that the second flow path 12 is cleaned. Before the second flow path cleaning process is executed, the second external flow path 76 and fourth external flow path 78 are attached as illustrated in FIG. 13. In the second flow path cleaning process, the controller 15 controls the operations of the first valve 82*a*, second valve 84*a*, third valve 86*a*, fourth valve 88*a*, and first external valve 89, and also controls the operations of the fifth pump 99, first external pump 102, second external pump 104, and fourth external pump 108. In step S20*a*, therefore, the cleaning liquid in the first chamber 541 in the cleaning tank 54 is supplied to the discharging head 40 through the second external flow path 76, and the cleaning liquid that has passed through the discharging head 40 is fed back to the second chamber 542 in the cleaning tank 54 through the fourth external flow path 78. Step S20*a* is executed for a predetermined length of time. As described above, in the second flow path cleaning process, the cleaning liquid is circulated between the second flow path 12 and the cleaning tank 54.

Referring again to FIG. 11, after step S20*a*, a first flow path cleaning process is executed in step S30*a*. In the first flow path cleaning process, the cleaning liquid that has been used to clean the second flow path 12 by passing through the second flow path 12 is caused to pass through the first flow path 11 so that the first flow path 11 is cleaned. Before the first flow path cleaning process is started, the second external flow path 76 is removed and the fourth external flow path 78 is attached, as illustrated in FIG. 14. In the first flow path cleaning process, the controller 15 controls the operations of the first valve 82*a*, second valve 84*a*, third valve 86*a*, fourth valve 88*a*, and first external valve 89, and also controls the operations of the fifth pump 99, first external pump 102, third external pump 106, and fourth external pump 108. In step S30*a*, therefore, the cleaning liquid stored in the first chamber 541 in the cleaning tank 54, the cleaning liquid having been used in the second flow path cleaning process, is supplied to the coupling flow path 62, liquid tank 30, and supply flow path 64 through the first external flow path 74. The cleaning liquid that has passed through the supply flow path 64 is fed back to the second chamber 542 in the cleaning tank 54 through the third external flow path 77. The first flow path cleaning process is executed for a predetermined length of time. As described above, in the first flow path cleaning process, the cleaning liquid is circulated between the first flow path 11 and the cleaning tank 54.

The cleaning liquid may be dirtied to the extent that the contamination degree indicated by a detection result from the contamination degree sensor 22 exceeds the first threshold during the execution of step S10*a* or S20*a*. When this happens, the controller 15 temporarily stops processing in steps S10*a* or S20*a*. The controller 15 then executes an ejection process in which, with the first external valve 89 open, the cleaning liquid in the cleaning tank 54 is ejected to the external waste water tank 56 due to the own weight of the cleaning liquid. A pump may be provided in the external waste water flow path 58 so that the cleaning liquid in the cleaning tank 54 is ejected to the external waste water tank 56 by driving the pump. The amount of cleaning liquid to be ejected from the cleaning tank 54 to the external waste water tank 56 may be the whole of the cleaning liquid stored in the cleaning tank 54 or may be part of the cleaning liquid stored in it.

When a detection result from the liquid surface sensor 555 indicates that the amount of cleaning liquid stored in the cleaning tank 54 has fallen below a predetermined amount, the controller 15 executes a process in which the user is notified, through a monitor, of a message prompting the user to resupply the cleaning liquid to the cleaning tank 54. In response to the message, the user executes a resupply process in which the cleaning liquid is resupplied in the cleaning tank 54. Since the cleaning liquid can be resupplied in the cleaning tank 54, it is possible to suppress a drop in cleaning efficiency, which would otherwise be caused when the cleaning liquid becomes insufficient.

The second embodiment described above has an effect similar to that in the first embodiment in that constituent components and processes in the second embodiment are similar to those in the first embodiment. For example, in the second embodiment, the second flow path 12 has a smaller volume than the first flow path 11, so the contamination degree of the cleaning liquid used in the second flow path cleaning process is relatively low. Therefore, when the first flow path 11 is cleaned with the cleaning liquid that has been used to clean the second flow path 12, the contamination degree of the cleaning liquid being relatively low, the cleaning liquid can be efficiently used. Thus, it is possible to suppress a drop in cleaning efficiency.

In the second embodiment described above, when the ejection process and resupply process are executed, it is possible to suppress an increase in the contamination degree of the cleaning liquid used in the first flow path cleaning process and second flow path cleaning process. Thus, it is possible to further suppress a drop in cleaning efficiency.

In the second embodiment described above, the first flow path cleaning process and second flow path cleaning process can be executed by using the cleaning liquid in the cleaning tank 54 disposed at a place different from the place of the cartridge attachment section 21. Thus, the cartridge 23 can be attached to or detached from the cartridge attachment section 21 even during the execution of the first flow path cleaning process or second flow path cleaning process. This can improve the user's working efficiency.

C. Third Embodiment

Figure 15:
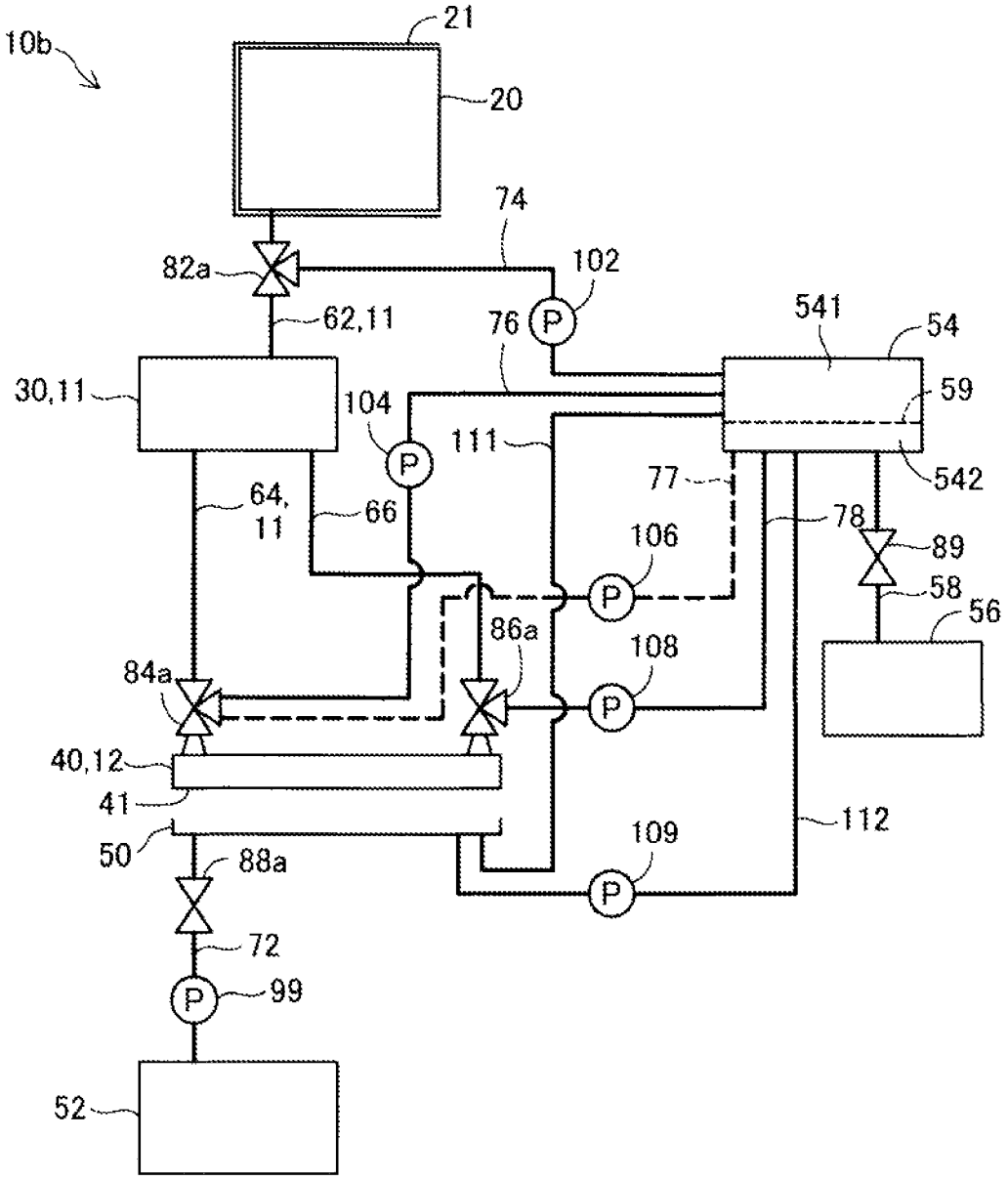
FIG. 15 schematically illustrates a liquid discharging apparatus in a third embodiment of the present disclosure.

FIG. 15 schematically illustrates a liquid discharging apparatus 10*b* in a third embodiment of the present disclosure. Constituent components of the liquid discharging apparatus 10*b* in this embodiment that are the same as with the liquid discharging apparatus 10*a*, illustrated in FIG. 10, in the second embodiment will be given the same reference characters, and descriptions will be omitted. The liquid discharging apparatus 10*b* illustrated in FIG. 15 further has a first cap-use flow path 111, a second cap-use flow path 112, and a cap-use pump 109.

The first cap-use flow path 111 and second cap-use flow path 112 are used to clean the liquid discharging apparatus 10*b* with a cleaning liquid. The first cap-use flow path 111 and second cap-use flow path 112 are each formed from, for example, a tube. The first cap-use flow path 111 and second cap-use flow path 112 can be attached to or detached from the liquid discharging apparatus 10*b*.

The first cap-use flow path 111 couples the cap 50 and the first chamber 541 in the cleaning tank 54 together. The second cap-use flow path 112 couples the cap 50 and the second chamber 542 in the cleaning tank 54 together. The cap-use pump 109 is disposed in the second cap-use flow path 112.

Figure 16:
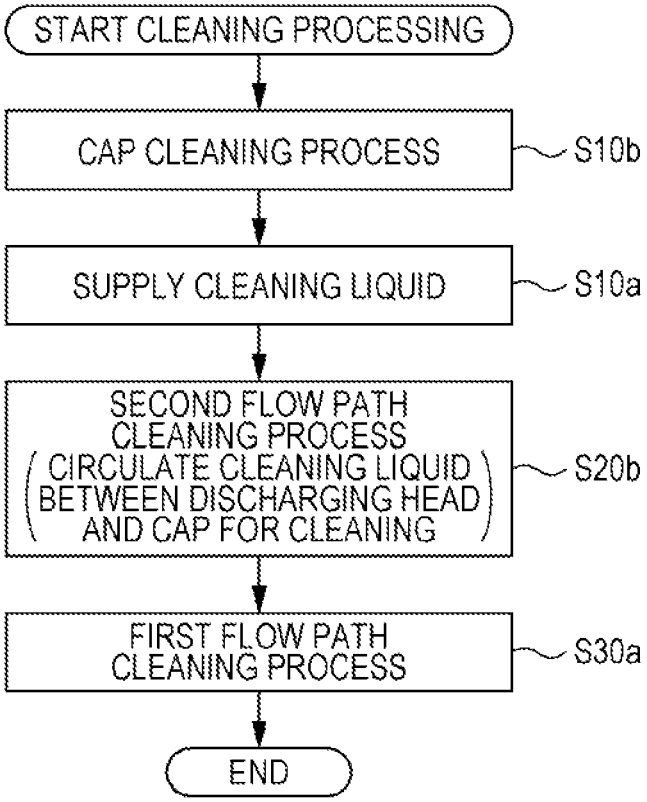
FIG. 16 is a flowchart for cleaning processing in the third embodiment.
Figure 17:
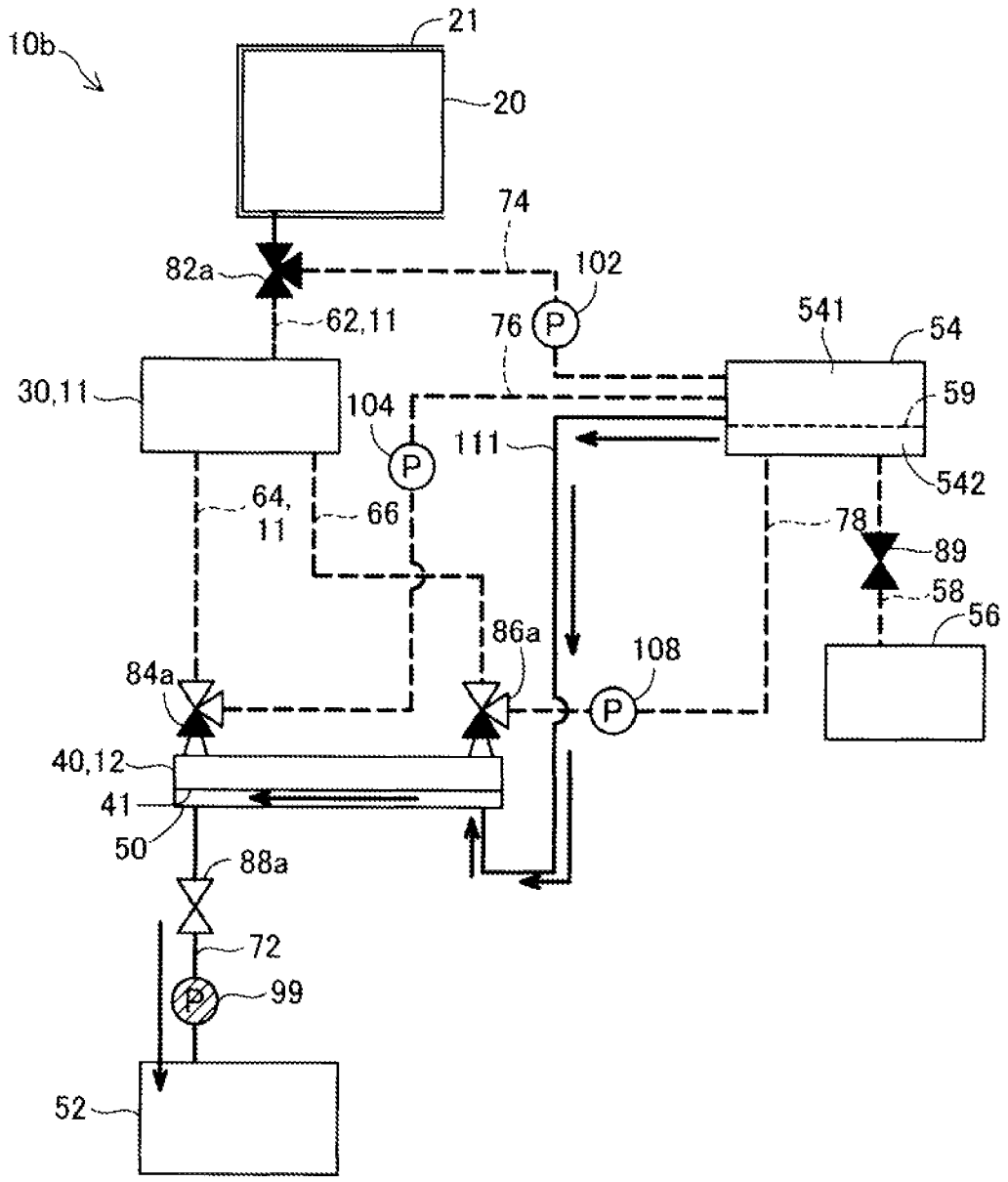
FIG. 17 is a drawing used to explain step S5.
Figure 18:
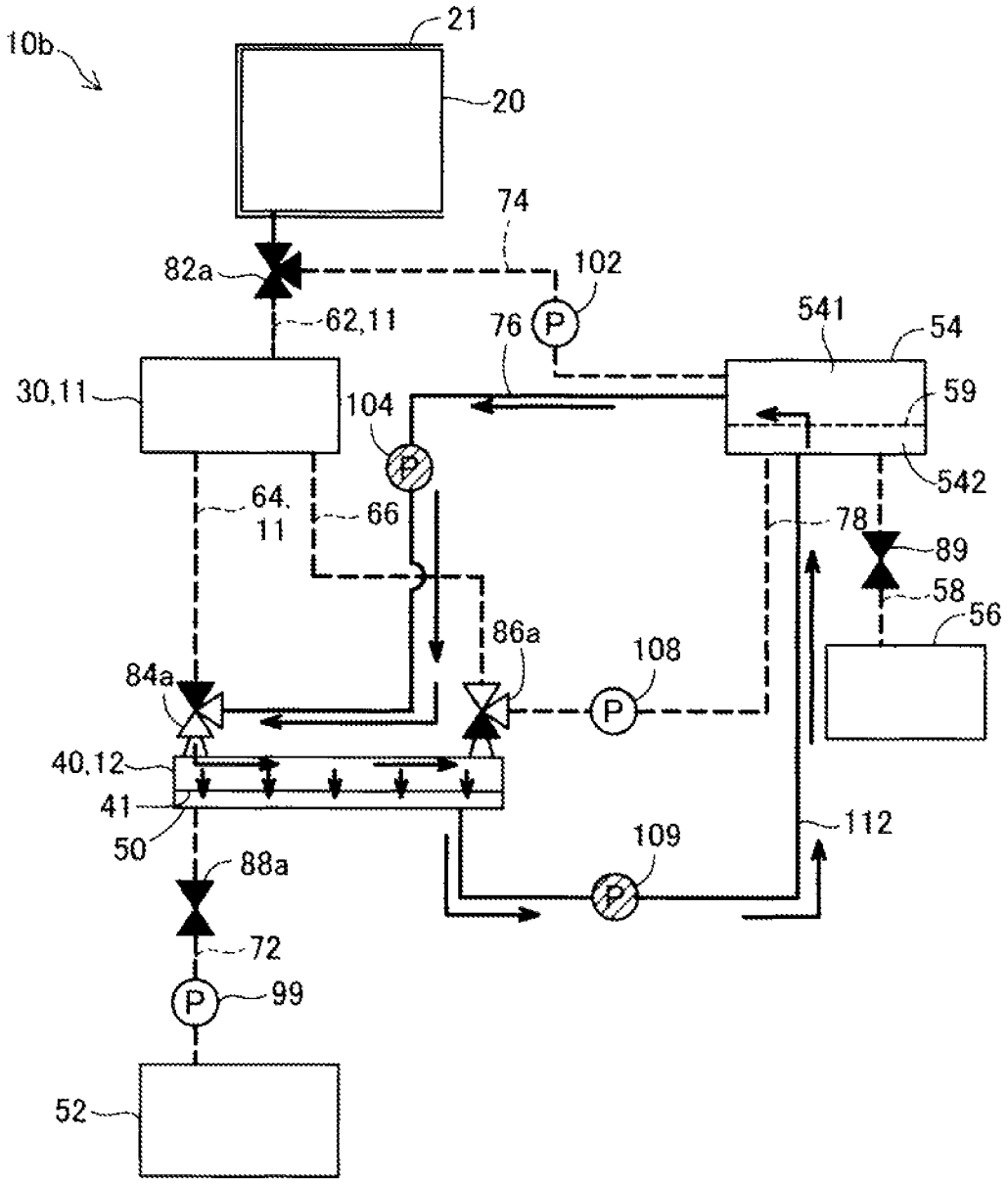
FIG. 18 is a drawing used to explain step S20*b*.

FIG. 16 is a flowchart for cleaning processing in the third embodiment. FIG. 17 is a drawing used to explain step S5. FIG. 18 is a drawing used to explain step S20*b*. In FIGS. 17 and 18, the orientations of the arrows indicate a direction in which a liquid flows. Also in FIGS. 17 and 18, the solid-black ports of the valves 82*a*, 84*a*, 86*a*, 88*a*, and 89 indicate that these ports are in the non-communication state, and the outline ports of these valves indicate that these ports are in the communication state. Also in FIGS. 17 and 18, some of the pumps 99, 102, 104, 106, 108, and 109 are hatched; the hatched pumps are operating. Also in FIGS. 17 and 18, flow paths through which a cleaning liquid is flowing are indicated by solid lines, and flow paths through which the cleaning liquid is not flowing are indicated by dotted lines.

As indicated in FIG. 16, in step S5, the controller 15 executes a cap cleaning process in which the cap 50 is cleaned. Step S5 is executed for a predetermined length of time. In the cap cleaning process, the cleaning liquid in the cleaning tank 54 is supplied to the cap 50, after which the cleaning liquid that has passed through the cap 50 is ejected to the waste water tank 52. As indicated in FIG. 17, the controller 15 seals the nozzle surface 41 with the cap 50. The controller 15 also controls the operations of the first valve 82*a*, second valve 84*a*, third valve 86*a*, and fourth valve 88*a* so that the cleaning liquid in the cleaning tank 54 passes through the first cap-use flow path 111, the interior of the concave portion of the cap 50, the first waste water flow path 72, and waste water tank 52 in that order. When the controller 15 drives the fifth pump 99, the cleaning liquid in the cleaning tank 54 is supplied to the cap 50 without passing through the first flow path 11 and second flow path 12. As a result, the cap 50 is cleaned.

Referring again to FIG. 16, after step S5, step S10*a* is executed. Thus, the residual ink remaining in the first flow path 11 and second flow path 12 is ejected to the waste water tank 52. After step S10*a*, the controller 15 executes the second flow path cleaning process in step S20*b*. In the second flow path cleaning process in step S20*b*, the cleaning liquid is circulated among the cleaning tank 54, discharging head 40, and cap 50 for a predetermined length of time so that the discharging head 40, which is the second flow path 12, is cleaned.

As indicated in FIG. 18, in step S20*b*, the controller 15 controls the operations of the first valve 82*a*, second valve 84*a*, third valve 86*a*, and fourth valve 88*a* so that a route is formed through which the cleaning liquid in the cleaning tank 54 passes through the second external flow path 76, discharging head 40, cap 50, and second cap-use flow path 112 in that order and then returns to the cleaning tank 54. The controller 15 also drives the second external pump 104 and cap-use pump 109 to circulate the cleaning liquid.

Referring again to FIG. 16, after step S20*b*, the first flow path cleaning process is executed in step S30*a*. Step S30*a* is similar to step S30*a* in the second embodiment.

The third embodiment described above has an effect similar to that in the first embodiment in that constituent components and processes in the third embodiment are similar to those in the first embodiment. For example, in the third embodiment, the second flow path 12 has a smaller volume than the first flow path 11, so the contamination degree of the cleaning liquid used in the second flow path cleaning process is relatively low. Therefore, when the first flow path 11 is cleaned with the cleaning liquid that has been used to clean the second flow path 12, the contamination degree of the cleaning liquid being relatively low, the cleaning liquid can be efficiently used. Thus, it is possible to suppress a drop in cleaning efficiency.

Also in the third embodiment, when cleaning processing is started as indicated in FIG. 16, the cap cleaning process is first executed in step S5. The cap 50 is used during, for example, the cleaning of the nozzle surface 41, so the contamination degree of the cap 50 is high. Therefore, when the cap 50 is first cleaned and then the cleaning liquid used for cleaning is ejected to the waste water tank 52, it is possible to suppress an increase in the contamination degree of the cleaning liquid in the second flow path cleaning process, in which the cleaning liquid is circulated for cleaning between the discharging head 40 and the cap 50.

D. Fourth Embodiment

Figure 19:
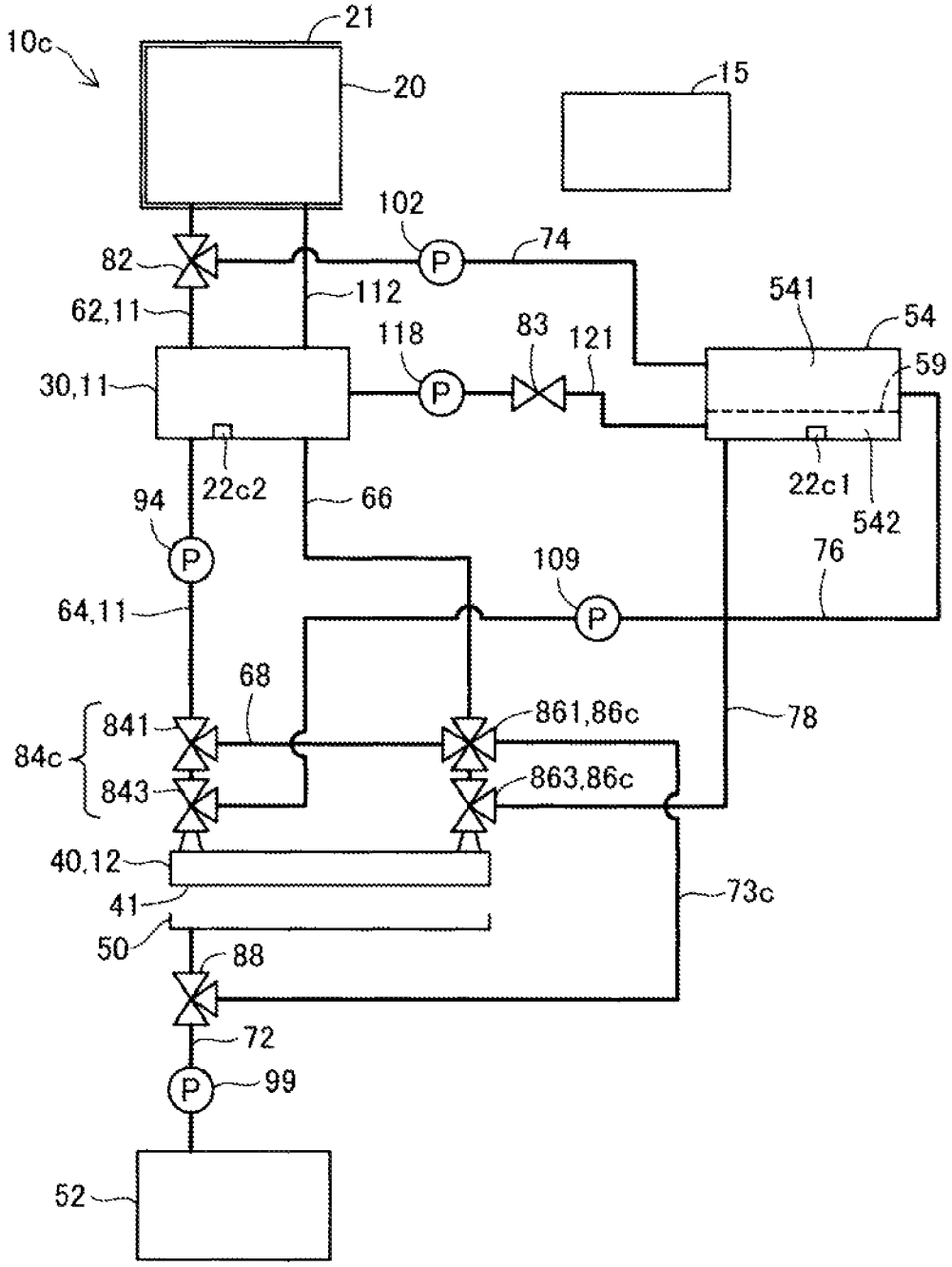
FIG. 19 schematically illustrates a liquid discharging apparatus in a fourth embodiment of the present disclosure.

FIG. 19 schematically illustrates a liquid discharging apparatus 10*c* in a fourth embodiment of the present disclosure. Constituent components of the liquid discharging apparatus 10*c* in this embodiment that are the same as with the liquid discharging apparatuses 10 to 10*b* in the first to third embodiments described above will be given the same reference characters, and descriptions will be omitted. In the liquid discharging apparatus 10*c* illustrated in FIG. 19, a first cleaning tank 20, which is the cleaning tank 20 described above, is attached in the cartridge attachment section 21, and a second cleaning tank 54, which is the cleaning tank 54 described above, is disposed at a place different from the place of the cartridge attachment section 21. In this embodiment, no cleaning liquid is stored in the second cleaning tank 54 in an initial state. The second cleaning tank 54 has a contamination degree sensor 22*c*1. The liquid tank 30 has a contamination degree sensor 22*c*2.

The liquid discharging apparatus 10*c* further has a liquid tank communication flow path 121 that couples the liquid tank 30 and the second chamber 542 in the second cleaning tank 54 together. The liquid tank communication flow path 121 includes a pump 118 and a shut-off valve 83. The liquid tank communication flow path 121 may couples the liquid tank 30 and the first chamber 541 in the second cleaning tank 54 together.

The second valve 84*c* is constituted by two valves 841 and 843. The third valve 86 is also constituted by two valves 861 and 863. When the opening and closing of the ports of the valves 841, 843, 861, and 863 are controlled, the open/closed states and communication states of the flow paths coupled to the ports can be switched.

Figure 20:
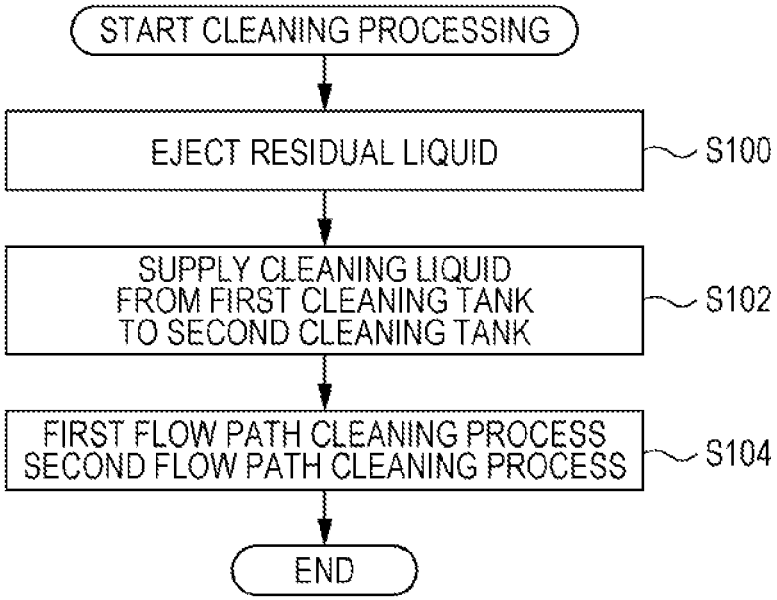
FIG. 20 is a first flowchart for cleaning processing in the fourth embodiment.
Figure 21:
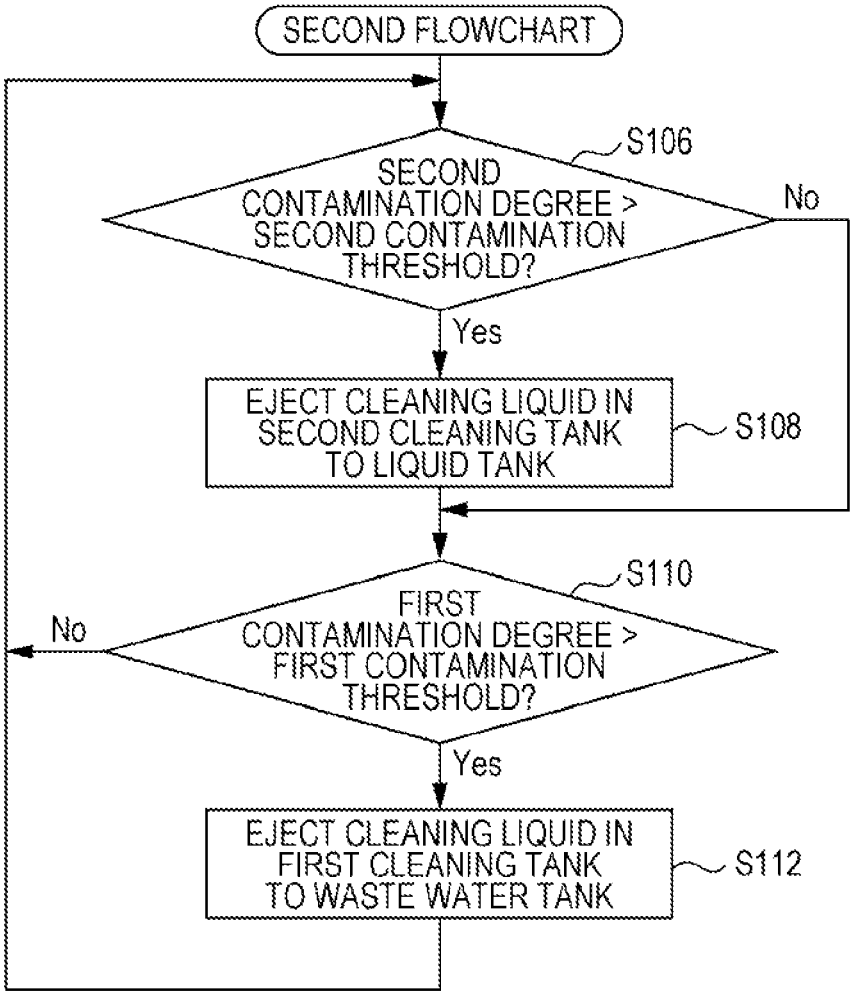
FIG. 21 is a second flowchart for cleaning processing in the fourth embodiment.
Figure 22:
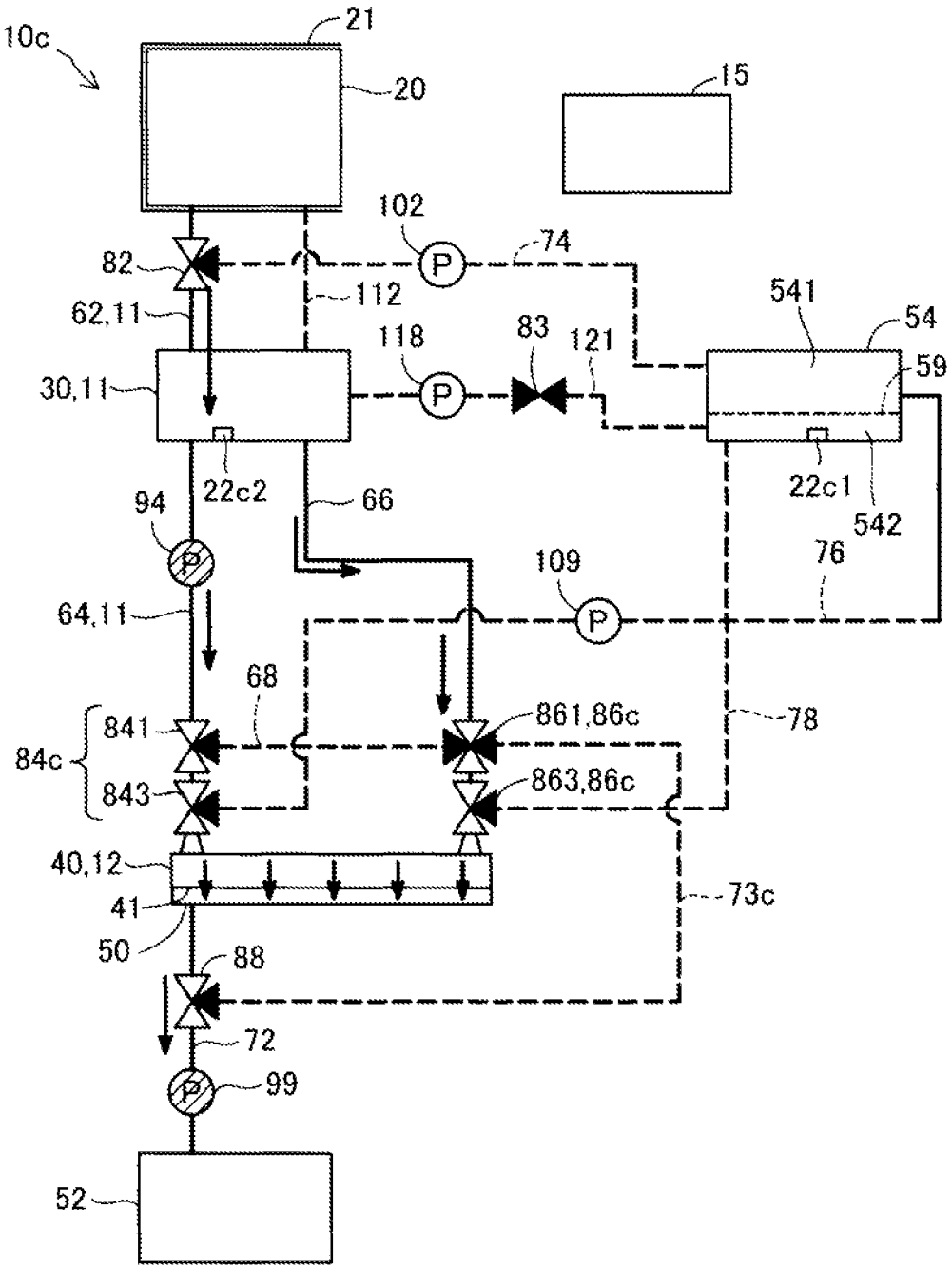
FIG. 22 is a drawing used to explain step S100.
Figure 23:
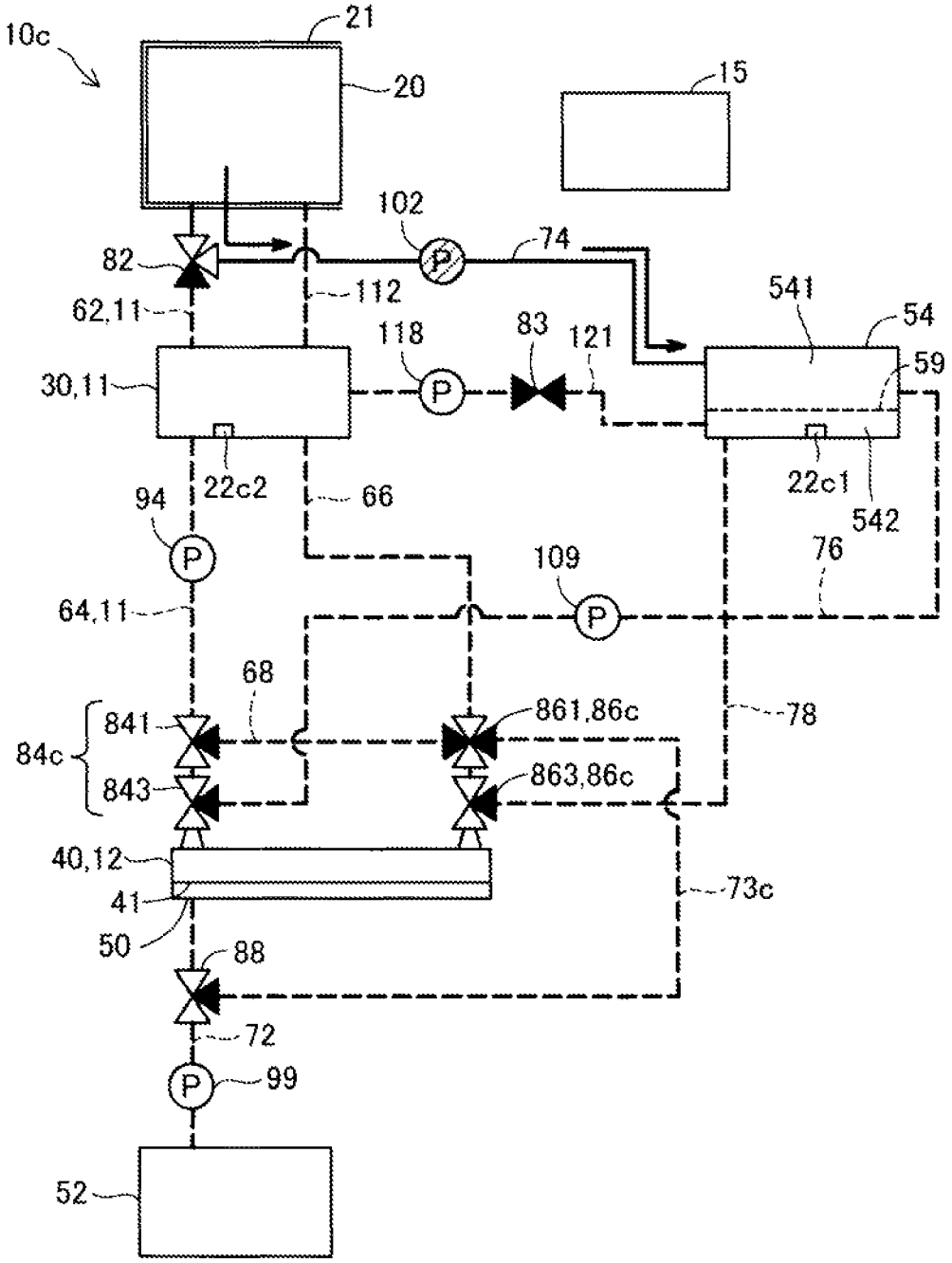
FIG. 23 is a drawing used to explain step S102.
Figure 24:
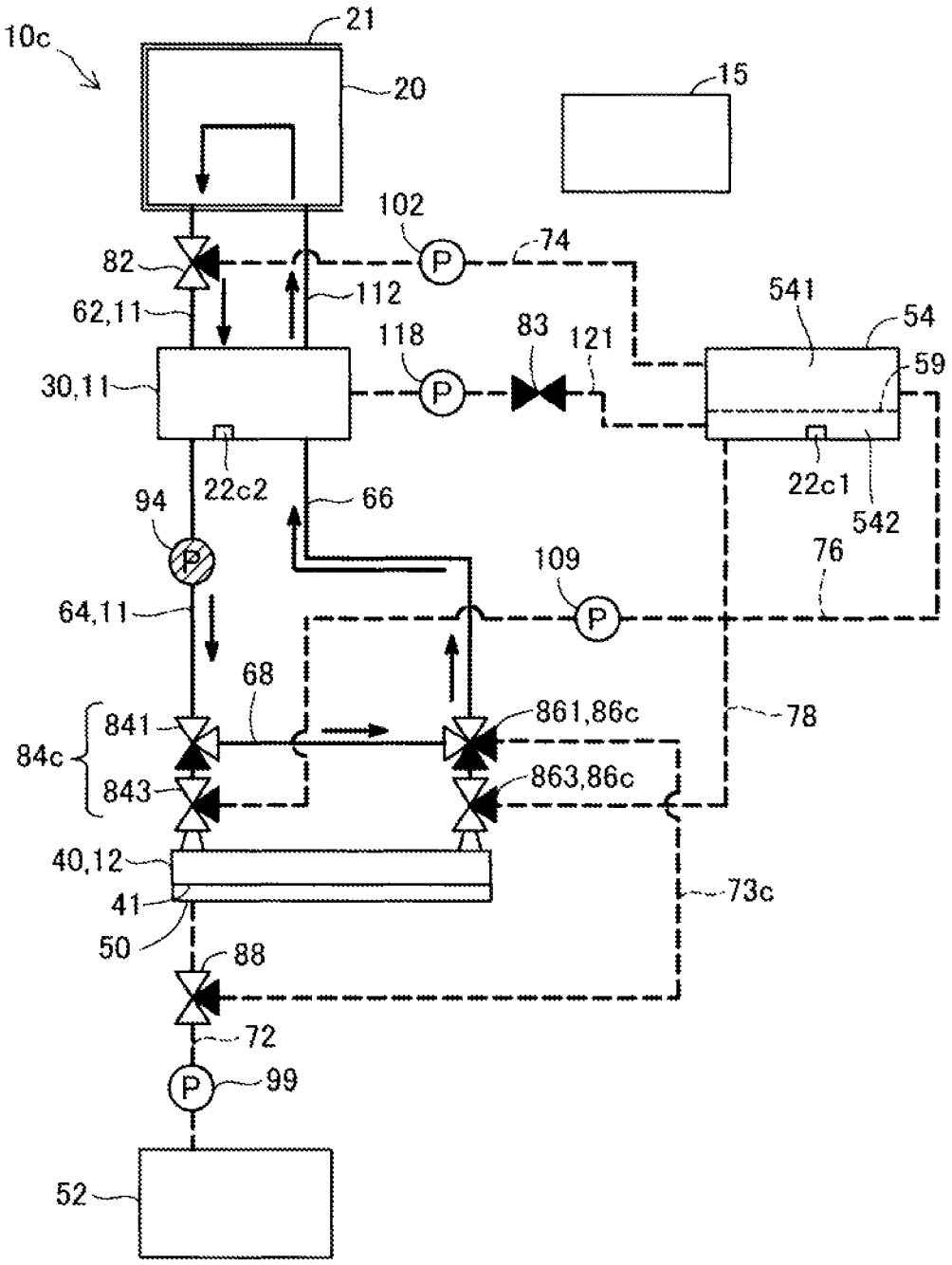
FIG. 24 is a first drawing used to explain step S104.
Figure 25:
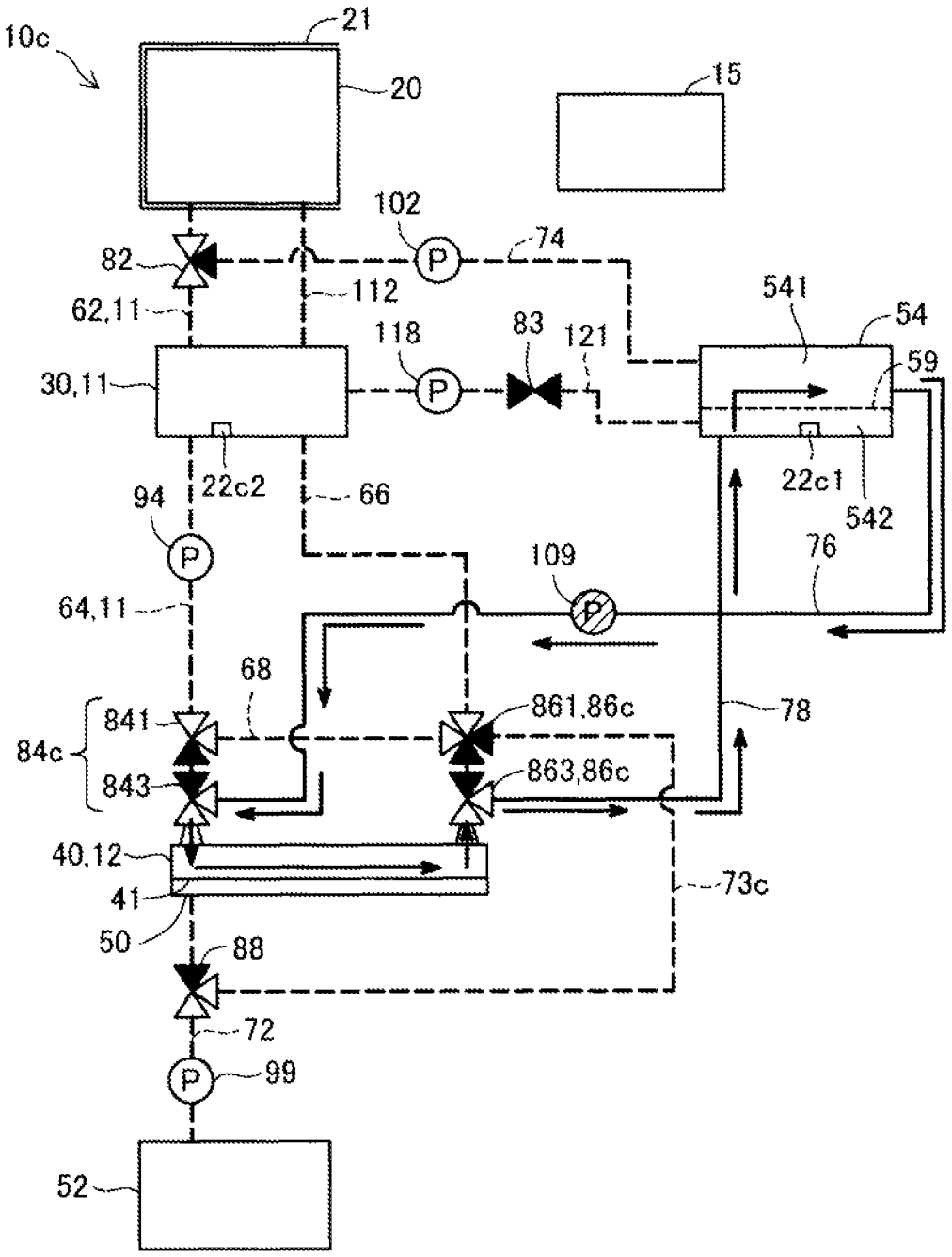
FIG. 25 is a second drawing used to explain step S104.
Figure 26:
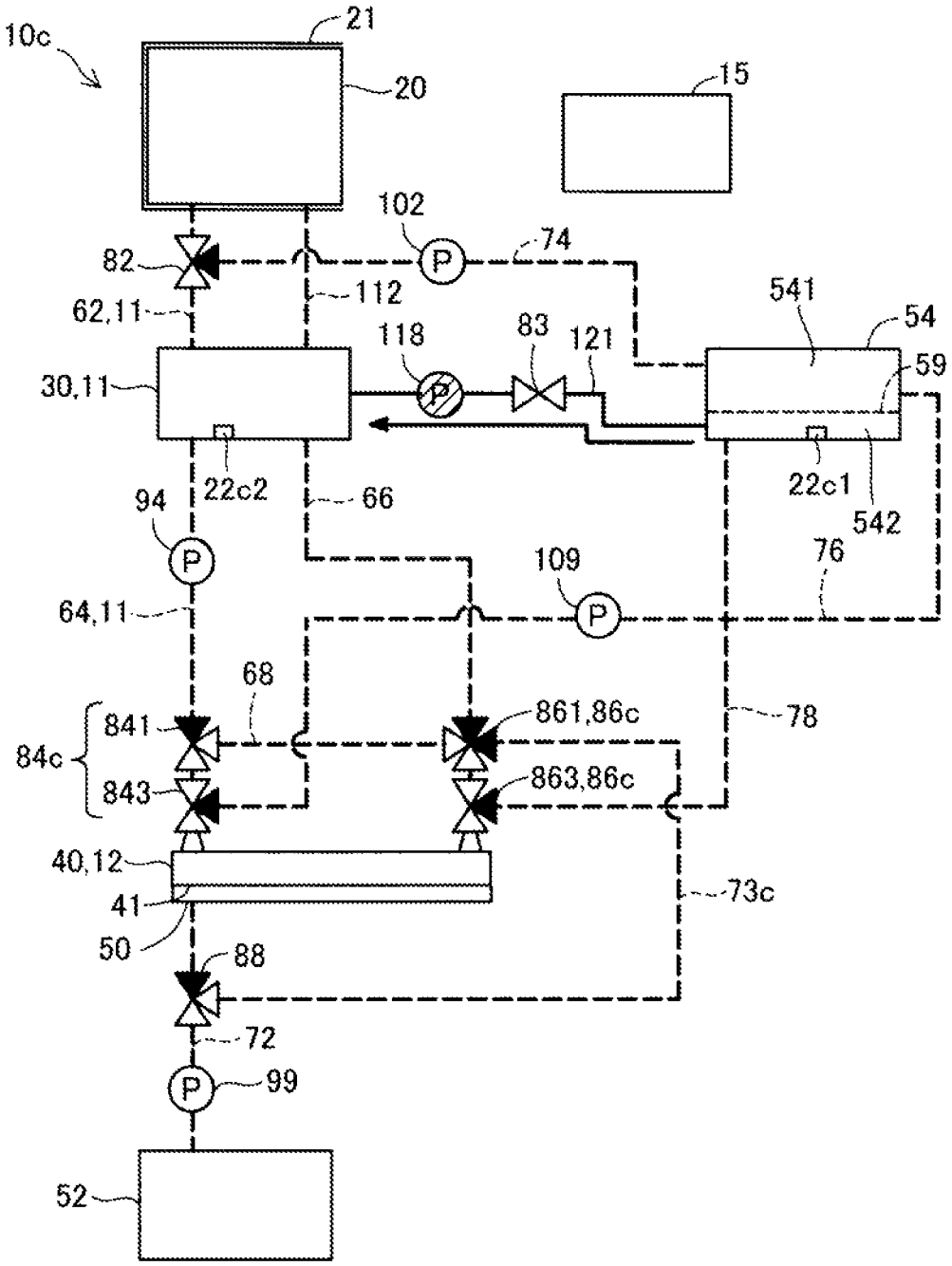
FIG. 26 is a drawing used to explain step S108.
Figure 27:
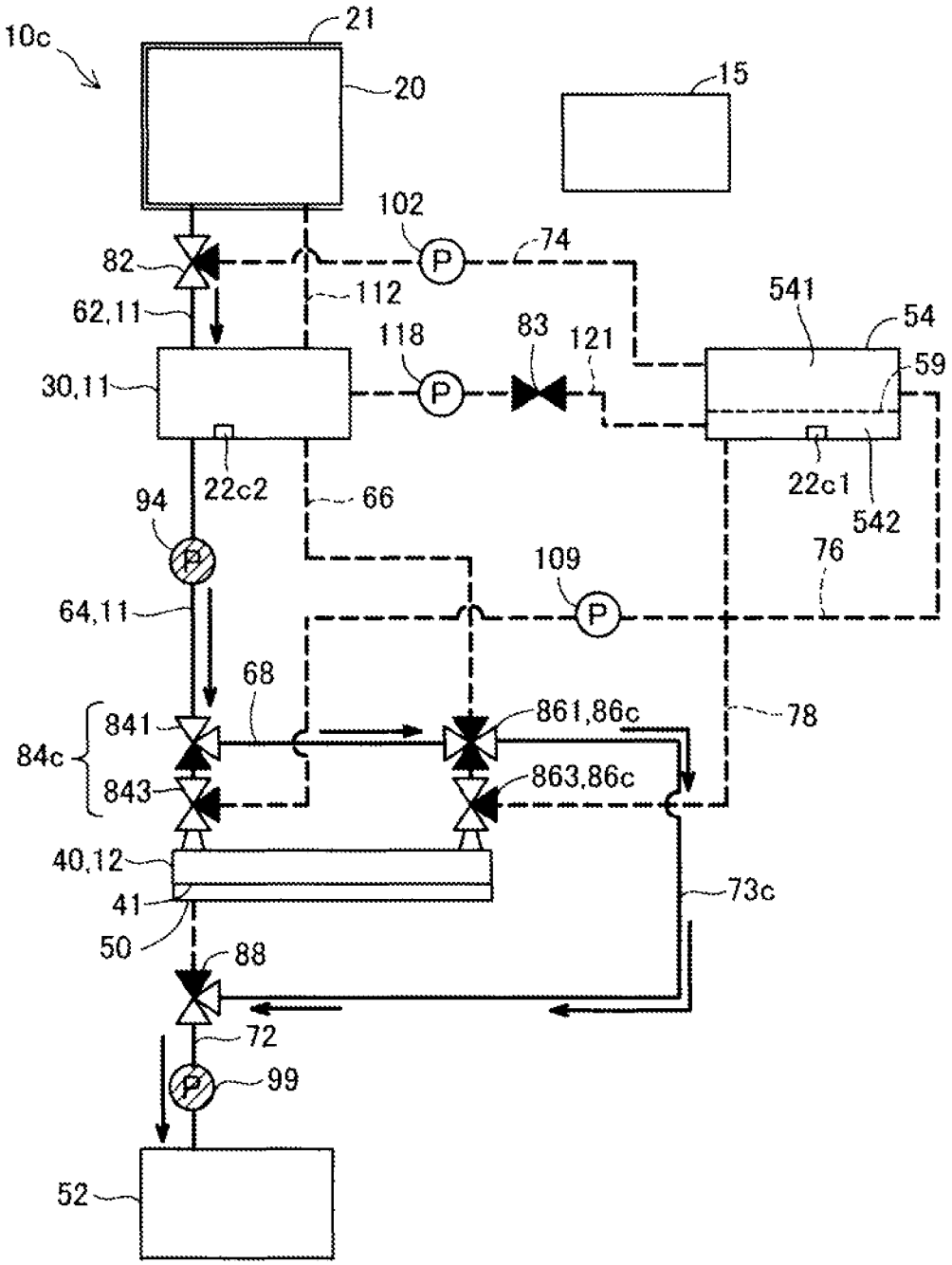
FIG. 27 is a drawing used to explain step S112.

FIG. 20 is a first flowchart for cleaning processing in the fourth embodiment. FIG. 21 is a second flowchart for cleaning processing in the fourth embodiment. FIG. 22 is a drawing used to explain step S100. FIG. 23 is a drawing used to explain step S102. FIG. 24 is a first drawing used to explain step S104. FIG. 25 is a second drawing used to explain step S104. FIG. 26 is a drawing used to explain step S108. FIG. 27 is a drawing used to explain step S112. In FIGS. 22 to 26, the orientations of the arrows indicate a direction in which a liquid flows. Also in FIGS. 22 to 26, the solid-black ports of the valves 82, 84*c*, 88, 83, and 86*c* indicate that these ports are in the non-communication state, and the outline ports of these valves indicate that these ports are in the communication state. Also in FIGS. 22 to 26, some of the pumps 94, 99, 102, 104, and 118 are hatched; the hatched pumps are operating. Also in FIGS. 22 to 26, flow paths through which a cleaning liquid is flowing are indicated by solid lines, and flow paths through which the cleaning liquid is not flowing are indicated by dotted lines.

Referring again to FIG. 20, in step S100, the controller 15 supplies the cleaning liquid from the first cleaning tank 20 to the first flow path 11 and second flow path 12 to eject the residual liquid. Step S100 is executed when, for example, the user commands the liquid discharging apparatus 10*c* to perform residual liquid ejection processing through a monitor or the like. In residual liquid ejection processing, the controller 15 seals the nozzle surface 41 with the cap 50 as illustrated in FIG. 22. The controller 15 also controls the operations of the valves 82, 84*c*, 88, 83, and 86*c* and the operations of the pumps 94, 99, 102, 104, and 118. Thus, the cleaning liquid flows from the first cleaning tank 20 through the coupling flow path 62 to the liquid tank 30, after which the cleaning liquid that has reached the liquid tank 30 passes through the supply flow path 64 or circulation flow path 66 and flows into the discharging head 40. The cleaning liquid that has reached the discharging head 40 is ejected to the waste water tank 52 through the cap 50 and first waste water flow path 72. As a result, the cleaning liquid forces the ink resulting in the residual liquid to flow into the waste water tank 52.

Referring again to FIG. 20, after step S100, the controller 15 supplies the cleaning liquid from the first cleaning tank 20 to the second cleaning tank 54 in step S102. The controller 15 controls the operations of the valves 82, 84*c*, 88, 83, and 86*c* and the operations of the pumps 94, 99, 102, 104, and 118, as illustrated in FIG. 23. Thus, the first cleaning tank 20 and the first chamber 541 in the second cleaning tank 54 communicate with each other through the first external flow path 74. When the first external pump 102 is driven, the cleaning liquid is supplied from the first cleaning tank 20 to the second cleaning tank 54.

Referring again to FIG. 20, after step S102, the controller 15 executes the first flow path cleaning process and second flow path cleaning process in step S104. In the first flow path cleaning process, the cleaning liquid is circulated between the first cleaning tank 20 and the first flow path 11. In the second flow path cleaning process, the cleaning liquid is circulated between the second cleaning tank 54 and the second flow path 12. There is at least a partial overlap between a period during which the first flow path cleaning process is executed and a period during which the second flow path cleaning process is executed. In this embodiment, the first flow path cleaning process and second flow path cleaning process are executed in the same period in step S104, and are terminated when the execution has continued for a predetermined length of time from the start of step S104.

The controller 15 controls the operations of the valves 82, 84*c*, 88, 83, and 86*c* and the operations of the pumps 94, 99, 102, 104, and 118, as illustrated in FIG. 24. Thus, the cleaning liquid in the first cleaning tank 20 is circulated through the first flow path 11 to clean the first flow path 11. The controller 15 also controls the operations of the valves 82, 84*c*, 88, 83, and 86*c* and the operations of the pumps 94, 99, 102, 104, and 118, as illustrated in FIG. 25. Thus, the cleaning liquid in the second cleaning tank 54 is circulated through the discharging head 40, which is the second flow path 12 to clean the second flow path 12.

The controller 15 repeatedly executes all steps in FIG. 21 from when step S104 starts until it is terminated. The controller 15 first decides in step S106 whether a second contamination degree indicated by a detection result from the contamination degree sensor 22*c*1 is higher than a second threshold. When the decision result in step S106 is No, step S110 is executed. When the decision result in step S106 is Yes, the controller 15 executes step S108. In step S108, the cleaning liquid in the second cleaning tank 54 is ejected to the liquid tank 30. The whole amount of cleaning liquid stored in the second cleaning tank 54 or only a predetermined amount of cleaning liquid in it may be ejected from the second cleaning tank 54 to the liquid tank 30. The cleaning liquid is resupplied to the second cleaning tank 54 by an amount equal to the amount of cleaning liquid ejected to the liquid tank 30. The user may resupply the cleaning liquid directly to the second cleaning tank 54, for example. Alternatively, the controller 15 may resupply the cleaning liquid from the first cleaning tank 20 through the first external flow path 74 to the second cleaning tank 54. While step S108 is being executed, step S104 may be stopped or executable processes such as the first flow path cleaning process may be executed.

After the cleaning liquid has been ejected from the second cleaning tank 54 to the liquid tank 30 in step S108, the cleaning liquid is circulated in the first flow path cleaning process. This enables the cleaning liquid to be effectively used. Thus, it is possible to suppress a drop in cleaning efficiency.

The controller 15 controls the operations of the valves 82, 84*c*, 88, 83, and 86*c* and the operations of the pumps 94, 99, 102, 104, and 118, as illustrated in FIG. 26. Thus, the cleaning liquid in the second cleaning tank 54 is ejected to the liquid tank 30 through the liquid tank communication flow path 121.

The controller 15 decides in step S110 whether a first contamination degree indicated by a detection result from the contamination degree sensor 22*c*2 is higher than a first threshold, as illustrated in FIG. 21. When the decision result in step S110 is No, processing in step S106 is executed again. When the decision result in step S110 is Yes, the controller 15 ejects the cleaning liquid in the first cleaning tank 20 to the waste water tank 52 in step S112. In step S112, the whole amount of cleaning liquid stored in the first cleaning tank 20 or only a predetermined amount of cleaning liquid in it may be ejected. The cleaning liquid is resupplied to the first cleaning tank 20 by an amount equal to the amount of cleaning liquid ejected to the waste water tank 52. The user may resupply cleaning liquid directly to the first cleaning tank 20, for example. While step S112 is being executed, step S104 may be stopped or executable processes such as the second flow path cleaning process may be executed.

In step S112, the controller 15 controls the operations of the valves 82, 84*c*, 88, 83, and 86*c* and the operations of the pumps 94, 99, 102, 104, and 118, as illustrated in FIG. 27. Thus, the cleaning liquid in the first cleaning tank 20 forces the cleaning liquid in the liquid tank 30 to be ejected to the waste water tank 52 through the supply flow path 64, a second cleaning flow path 68*c*, a second waste water flow path 73*c*, and the first waste water flow path 72. After the execution of step S112, step S106 is executed again.

In the fourth embodiment described above, there is at least a partial overlap between a period during which the first flow path cleaning process is executed and a period during which the second flow path cleaning process is executed. Therefore, the time taken for cleaning can be shortened, making it possible to suppress a drop in cleaning efficiency. Also in the fourth embodiment described above, when the second contamination degree of the cleaning liquid, which will be used to clean the second flow path 12, in the second cleaning tank 54 is higher than the second threshold, the liquid to be used to clean the second flow path 12 is ejected to the liquid tank 30, as indicated in steps S106 and S108 in FIG. 21. This enables the cleaning liquid to be effectively used. When the first contamination degree of the cleaning liquid in the liquid tank 30 is higher than the first threshold, the cleaning liquid in the first cleaning tank 20 is ejected to the waste water tank 52, as indicated in steps S110 and S112 in FIG. 21. Then, the cleaning liquid is resupplied to the first cleaning tank 20 by an amount equal to the amount of ejected cleaning liquid. This enables the first flow path 11 to be efficiently cleaned by using the cleaning liquid with a lower contamination degree.

E. Other Embodiments

E-1. First Another Embodiment

In the embodiments described above, two types of caps may be provided as the cap 50, a cleaning cap used during cleaning and a normal-use cap used for normal cleaning. This can reduce the possibility that dirt attached to the normal-use cap during normal cleaning enters the discharging head 40 during cleaning.

E-2. Second Another Embodiment

In the first flow path cleaning process in the embodiments described above, at least a first process in which the liquid tank 30 is cleaned and a second process in which the coupling flow path 62 is cleaned may be different processes. In this case, there is preferably at least a partial overlap between a period during which the first process is executed and a period during which the second process is executed. This enables the time taken for cleaning to be further shortened.

E-3. Third Another Embodiment

In the second to fourth embodiments described above, a process may be provided in which when the contamination degree of the cleaning liquid in the cleaning tank 54 exceeds a predetermined reference threshold, the cleaning liquid is caused to flow from the first chamber 541 to the second chamber 542. Thus, dust attached to the filter 59 can be removed.

E-4. Fourth Another Embodiment

In the embodiments described above, a cleaning liquid filling process may be provided in which upon the completion of cleaning, the first flow path 11 and second flow path 12 are filled with the cleaning liquid. The cleaning liquid filling process restrains the first flow path 11 and second flow path 12 from being dried, so it is possible to reduce the possibility that dust and the like adhere to the inner wall surfaces of the first flow path 11 and second flow path 12. The cleaning liquid filling process is preferably executed when it is predicted that the first flow path 11 and second flow path 12 will not be filled with the liquid in the cartridge 23 for a predetermined length of time or longer.

E-5. Fifth Another Embodiment

In step S10, indicated in FIG. 2, in the first embodiment described above, the residual liquid may be ejected by supplying the cleaning liquid to the first flow path 11 and second flow path 12 so that the cleaning liquid forces the residual liquid to flow outward. Alternatively, the cleaning liquid may be supplied to the first flow path 11 and second flow path 12 after step S10, indicated in FIG. 2, in the first embodiment described above to eject the residual liquid. Thus, it is possible to restrain the cleaning liquid supplied to the first flow path 11 and second flow path 12 from being contaminated by the ink resulting in the residual liquid. In the second to fourth embodiments described above, the residual liquid may be ejected by sucking the residual liquid with the fifth pump 99 without supplying the cleaning liquid, instead of executing step S10*a* in FIG. 11, step S10*a* in FIG. 16, or step S100 in FIG. 20. When the residual liquid is ejected from the first flow path 11 and second flow path 12 without supplying the cleaning liquid, a mixture of the cleaning liquid and air can be used for cleaning in the first flow path cleaning process and second flow path cleaning process. Accordingly, the cleaning effect can be enhanced. Alternatively, in the second to fourth embodiments described above, the residual liquid may be ejected by being sucked with the fifth pump 99 before executing step S10*a* in FIG. 11, step S10*a* in FIG. 16, or step S100 in FIG. 20. When the residual liquid in the first flow path 11 and second flow path 12 is sucked with the fifth pump 99, sucking is preferably performed through the cap 50 so that a high negative pressure is not applied directly to the discharging head 40.

E-6. Sixth Another Embodiment

Although, in the second to fourth embodiments described above, each of the contamination degree sensors 22, 22*c*1, and 22c2 has been an optical sensor, each of them may be another device as long as it can detect a contamination degree. For example, the contamination degree sensors 22, 22c1, and 22c2 may be a timer. In this case, when a predetermine length of time has elapsed, it is decided that the contamination degree has exceeded the threshold in the relevant embodiment.

E-7. Seventh Another Embodiment

In the embodiments described above, constituent components, of the liquid discharging apparatuses 10 to 10c, that are not essential to the execution of the first flow path cleaning process or second flow path cleaning process may be omitted. In the second and third embodiments, for example, the circulation flow path 66 may be omitted.

E-8. Eighth Another Embodiment

In the second and third embodiments described above, a process may be provided in which the cleaning liquid in the cleaning tank 54 may be used to clean the cartridge 23 attached in the cartridge attachment section 21.

E-9. Ninth Another Embodiment

Although, in the above embodiments described above, the liquid discharging apparatuses 10 to 10c have been each an ink jet printer, the present disclosure can also be applied to liquid discharging apparatuses that discharge other types of liquids. For example, the present disclosure can be applied to a liquid discharging apparatus that discharges a liquid in which a material such as an electrode material used in the manufacturing of a liquid display is dispersed or dissolved and to a liquid discharging apparatus that expels a liquid including bio-organic substances used in the manufacturing of biochips.

F. Other Embodiments

The present disclosure is not limited to the embodiments described above; the present disclosure can be implemented in various forms without departing from the intended scope of the present disclosure. For example, the present disclosure can be implemented in aspects below. Technical features, in the above embodiments, corresponding to technical features in the aspects described below can be appropriately replaced or combined to solve part or all of the problems in the present disclosure or achieve part or all of the effects of the present disclosure. When these technical features are not described in this specification as being essential, the technical features can be appropriately deleted.

(1) According to an aspect of the present disclosure, a method of cleaning a liquid discharging apparatus is provided. The liquid discharging apparatus has a liquid tank that stores a liquid, a discharging head having nozzles from which the liquid is discharged, a supply flow path through which the liquid in the liquid tank is supplied to the discharging head, and a valve disposed in the supply flow path. When, with respect to a direction in which the liquid flows toward the discharging head, a flow path for the liquid, the flow path being disposed upstream of the valve, is taken as a first flow path and a flow path for the liquid, the flow path being disposed downstream of the valve, is taken as a second flow path, the second flow path has a smaller volume than the first flow path. The cleaning includes a second flow path cleaning step of causing a cleaning liquid to pass through the second flow path so that the second flow path is cleaned, and also includes a first flow path cleaning step of causing the cleaning liquid that has passed through the second flow path to pass through the first flow path so that the first flow path is cleaned.

According to this aspect, since the second flow path has a smaller volume than the first flow path, the contamination degree of the cleaning liquid used in the second flow path cleaning step is relatively low. Therefore, when the first flow path is cleaned with the cleaning liquid used to clean the second flow path, the contamination degree of the cleaning liquid being relatively low, the cleaning liquid can be efficiently used. Thus, it is possible to suppress a drop in cleaning efficiency.

(2) In the above aspect, the liquid discharging apparatus has a cleaning tank that stores the cleaning liquid and a sensor that detects the amount of the liquid stored in cleaning tank. The second flow path cleaning step is a step of cleaning the second flow path by using the cleaning liquid in the cleaning tank. The method may further include a step of, when the amount of the liquid stored in the cleaning tank, the amount being detected by the sensor, falls below a predetermined threshold, notifying the user to prompt the user to resupply the cleaning liquid.

According to this aspect, when the cleaning liquid has been lessened, the cleaning liquid can be resupplied to the cleaning tank. Therefore, it is possible to suppress a drop in cleaning efficiency, which would otherwise be caused when the cleaning liquid becomes insufficient.

(3) According to another aspect of the present disclosure, a method of cleaning a liquid discharging apparatus is provided. The liquid discharging apparatus has a liquid tank that stores a liquid, a discharging head having nozzles from which the liquid supplied from the liquid tank is discharged, a supply flow path through which the liquid in the liquid tank is supplied to the discharging head, and a valve disposed in the supply flow path. When, with respect to a direction in which the liquid flows toward the discharging head, a flow path for the liquid, the flow path being disposed upstream of the valve, is taken as a first flow path and a flow path for the liquid, the flow path being disposed downstream of the valve, is taken as a second flow path, the method includes a first flow path cleaning step of causing a cleaning liquid to pass through the first flow path so that the first flow path is cleaned and a second flow path cleaning step of causing the cleaning liquid to pass through the second flow path so that the second flow path is cleaned. There is at least a partial overlap between a period during which the first flow path cleaning step is executed and a period during which the second flow path cleaning step is executed.

According to this aspect, since there is at least a partial overlap between a period during which the first flow path cleaning step is executed and a period during which the second flow path cleaning step is executed, the time taken for cleaning can be shortened. This makes it possible to suppress a drop in cleaning efficiency.

(4) In the above aspect, the liquid discharging apparatus further has a liquid tank communication flow path that couples a second cleaning tank and the liquid tank together. The first flow path cleaning step is a step of circulating the cleaning liquid between the first flow path and a first cleaning tank that stores the cleaning liquid. The second flow path cleaning step is a step of circulating the cleaning liquid between the second flow path and the second cleaning tank that stores the cleaning liquid. When a contamination degree that indicates the extent to which the cleaning liquid in the second cleaning tank is dirtied is detected and the detected contamination degree exceeds a predetermined threshold, the cleaning liquid in the second cleaning tank may be ejected to the liquid tank through the liquid tank communication flow path and may be used as the cleaning liquid circulated in the first flow path cleaning step.

According to this aspect, since the cleaning liquid that has been used to clean the second flow path is ejected to the liquid tank and the cleaning liquid in the liquid tank is used as the cleaning liquid in the first flow path cleaning step, the cleaning liquid can be effectively used. Thus, it is possible to suppress a drop in cleaning efficiency.

The present disclosure can also be implemented by various forms other than a method of cleaning a liquid discharging apparatus. The present disclosure can be implemented in the form of, for example, a computer program that implements a cleaning method or a non-transitory recording medium that stores the computer program.

What is claimed is:

1. A method of cleaning a liquid discharging apparatus, wherein the liquid discharging apparatus has a liquid tank that stores a liquid, a discharging head having a nozzle from which the liquid is discharged, a supply flow path through which the liquid in the liquid tank is supplied to the discharging head, and a valve disposed in the supply flow path, and when, with respect to a direction in which the liquid flows toward the discharging head, a flow path for the liquid, the flow path being disposed upstream of the valve, is taken as a first flow path and a flow path for the liquid, the flow path being disposed downstream of the valve, is taken as a second flow path, the second flow path has a smaller volume than the first flow path, the method comprising:

a second flow path cleaning step of causing a cleaning liquid to pass through the second flow path so that the second flow path is cleaned; and a first flow path cleaning step of causing the cleaning liquid that has passed through the second flow path to pass through the first flow path so that the first flow path is cleaned.

2. The method according to claim 1, wherein the liquid discharging apparatus has a cleaning tank that stores the cleaning liquid and a sensor that detects an amount of the liquid stored in cleaning tank, and the second flow path cleaning step is a step of cleaning the second flow path by using the cleaning liquid in the cleaning tank, the method further comprising a step of, when the amount of the liquid stored in the cleaning tank, the amount being detected by the sensor, falls below a predetermined threshold, notifying a user to prompt the user to resupply the cleaning liquid.

3. A method of cleaning a liquid discharging apparatus, wherein the liquid discharging apparatus has a liquid tank that stores a liquid, a discharging head having a nozzle from which the liquid supplied from the liquid tank is discharged, a supply flow path through which the liquid in the liquid tank is supplied to the discharging head, and a valve disposed in the supply flow path, when, with respect to a direction in which the liquid flows toward the discharging head, a flow path for the liquid, the flow path being disposed upstream of the valve, is taken as a first flow path and a flow path for the liquid, the flow path being disposed downstream of the valve, is taken as a second flow path, the method comprising a first flow path cleaning step of causing a cleaning liquid to pass through the first flow path so that the first flow path is cleaned, and a second flow path cleaning step of causing the cleaning liquid to pass through the second flow path so that the second flow path is cleaned, and there is at least a partial overlap between a period during which the first flow path cleaning step is executed and a period during which the second flow path cleaning step is executed.

4. The method according to claim 3, wherein:

the liquid discharging apparatus further has a liquid tank communication flow path that couples a second cleaning tank and the liquid tank together;

the first flow path cleaning step is a step of circulating the cleaning liquid between the first flow path and a first cleaning tank that stores the cleaning liquid;

the second flow path cleaning step is a step of circulating the cleaning liquid between the second flow path and the second cleaning tank that stores the cleaning liquid; and when a contamination degree that indicates a degree to which the cleaning liquid in the second cleaning tank is dirtied is detected and the detected contamination degree exceeds a predetermined threshold, the cleaning liquid in the second cleaning tank is ejected to the liquid tank through the liquid tank communication flow path and is used as the cleaning liquid circulated in the first flow path cleaning step.

* * * * *